US007870635B2

(12) United States Patent
Yamada

(10) Patent No.: US 7,870,635 B2
(45) Date of Patent: Jan. 18, 2011

(54) CLEANING TOOL SHEET AND CLEANING TOOL

(76) Inventor: Kikuo Yamada, 403, Tiara Shimazuyama, 2-15 Higashi-Gotanda 1-chome, Shinagawa-ku, Tokyo 141-0022 (JP)

( * ) Notice: Subject to any disclaimer, the term of this patent is extended or adjusted under 35 U.S.C. 154(b) by 1063 days.

(21) Appl. No.: 11/494,589

(22) Filed: Jul. 28, 2006

(65) Prior Publication Data

US 2006/0282969 A1 Dec. 21, 2006

Related U.S. Application Data

(62) Division of application No. 10/577,992, filed on Jun. 16, 2006, now Pat. No. 7,712,178.

(30) Foreign Application Priority Data

Apr. 1, 2004 (JP) ..... 2004-109429
Apr. 16, 2004 (JP) ..... 2004-121408

(51) Int. Cl.
*B05C 1/00* (2006.01)

(52) U.S. Cl. ..... 15/230; 15/208; 15/226; 15/229.4

(58) Field of Classification Search ..... 15/209.1, 15/208, 223, 224, 226, 227, 229.4, 230
See application file for complete search history.

(56) References Cited

U.S. PATENT DOCUMENTS 6,968,591 B2 * 11/2005 Tanaka ..... 15/229.1
7,251,851 B2 * 8/2007 Lin et al. ..... 15/229.1
7,712,178 B2 * 5/2010 Yamada ..... 15/230

(Continued)

FOREIGN PATENT DOCUMENTS

JP 08-154881 6/1996

(Continued)

OTHER PUBLICATIONS

Corresponding Chinese Office Action.

(Continued)

*Primary Examiner*—Shay L Karls
(74) *Attorney, Agent, or Firm*—H. Jay Spiegel; Robert L. Haines; Michael T. Griggs

(57) ABSTRACT

The present invention relates to a cleaning tool sheet and a cleaning tool capable of use for wiping cleaning by contacting the surface of objects to be cleaned in various locations. In a cleaning tool sheet (1), fiber bundles (3) are laminated on one side face of a base sheet (2); the central parts in the direction of flow of the fibers constituting the fiber bundles (3) are joined by a central joining part (4) continuously formed in the central part of the base sheet (2) and joined at a spot-form joining part (7) formed intermittently on a parallel line between the central joining part (4) and two end edges (2*a*, 2*b*) parallel therewith. The two ends (31*a*, 31*b*) in the direction of flow of the fibers of the fiber bundles (3) are not joined to the base sheet (2). An attaching part (8) for attaching onto a holding member is provided at both ends of the base sheet (2).

27 Claims, 14 Drawing Sheets

U.S. PATENT DOCUMENTS

2005/0172440 A1* 8/2005 Lin ..... 15/226

FOREIGN PATENT DOCUMENTS

| | | |
|---|---|---|
| JP | 09-149873 | 6/1997 |
| JP | 305394 | 8/1998 |
| JP | 2000-245670 | 9/2000 |
| JP | 2000-296084 | 10/2000 |
| JP | 2002-369783 | 12/2002 |
| JP | 2003-000510 | 1/2003 |
| JP | 2003-265389 | 9/2003 |
| JP | 2003-265391 | 9/2003 |

OTHER PUBLICATIONS

CN 2229226 Y cited in Chinese Office Action.

* cited by examiner

【FIG1】
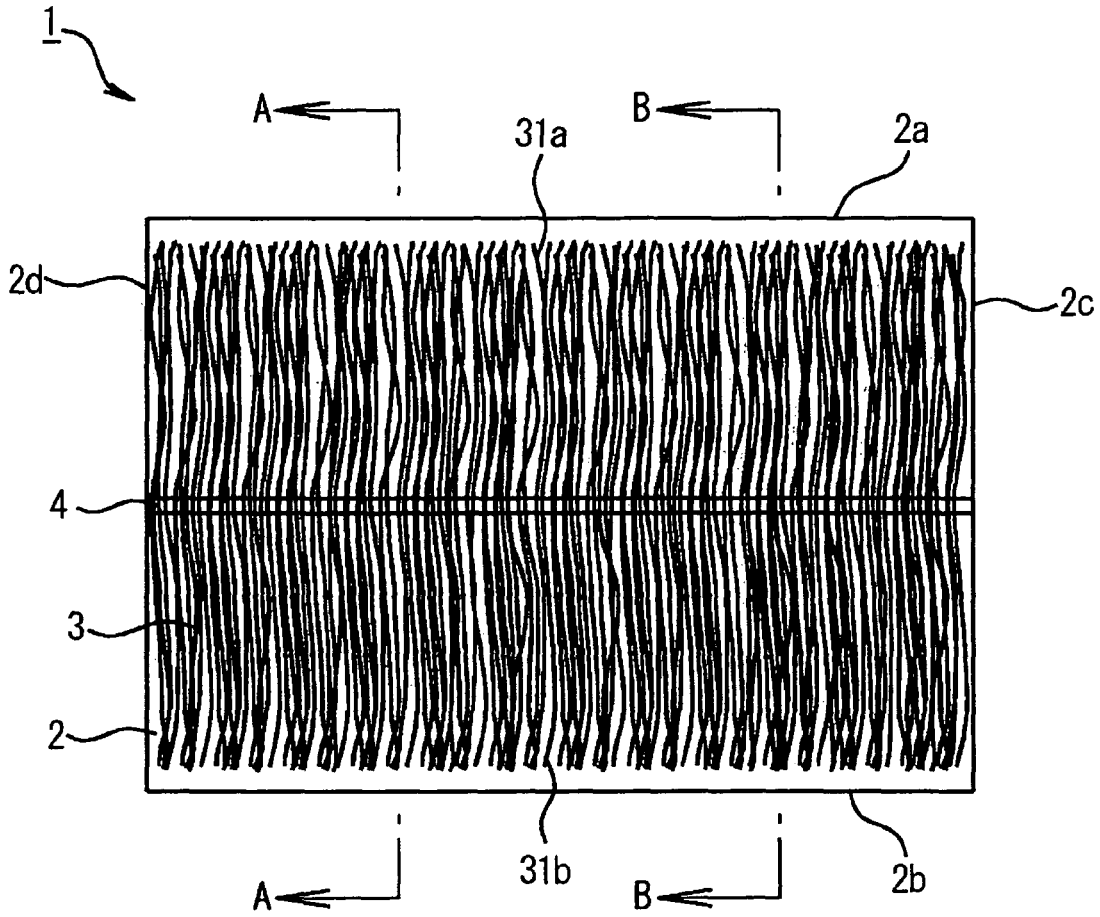

【FIG2】
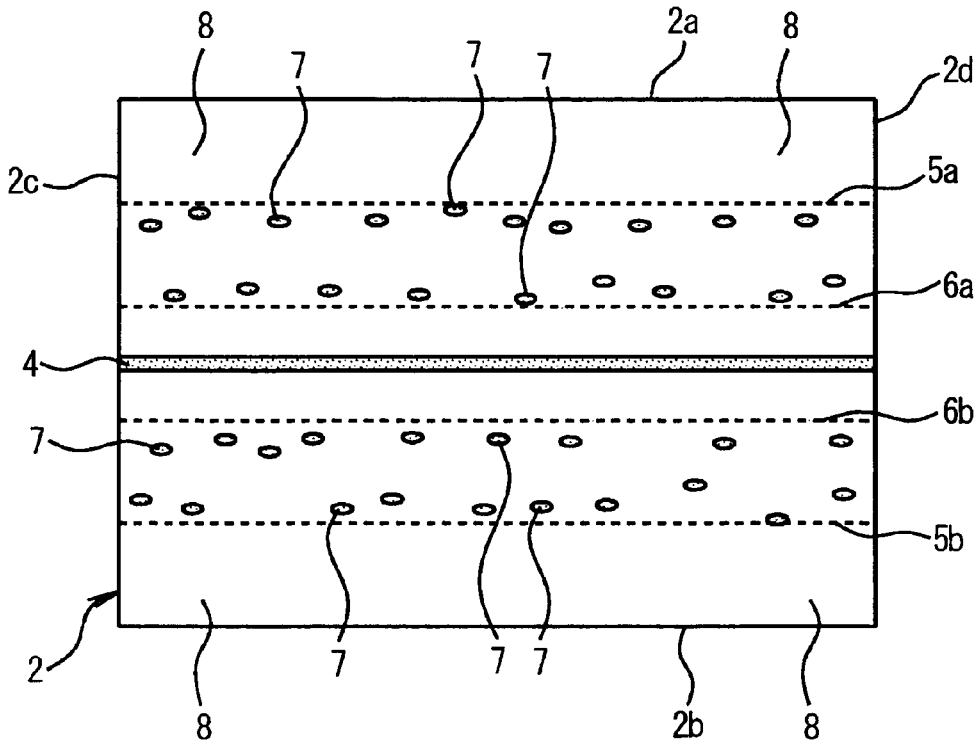
【FIG3】
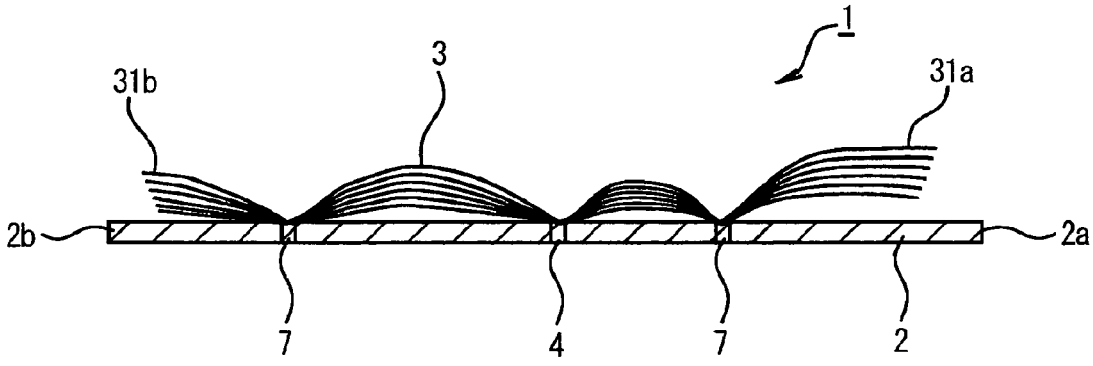

【FIG4】
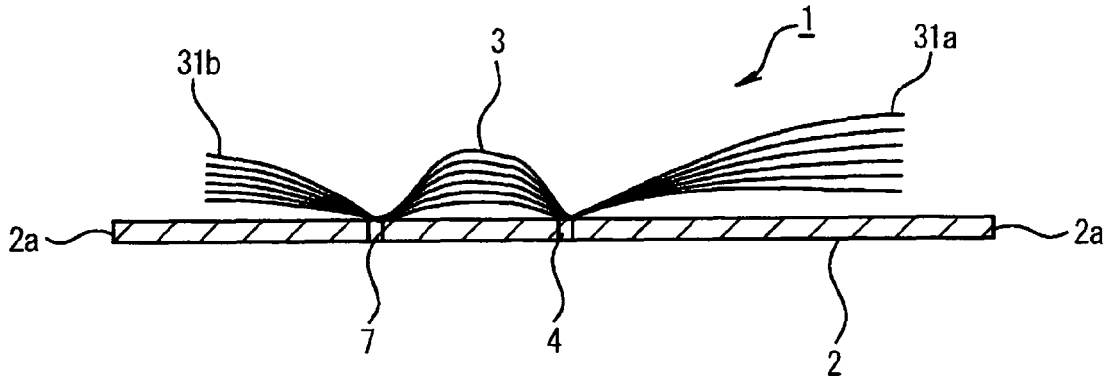

【FIG5】
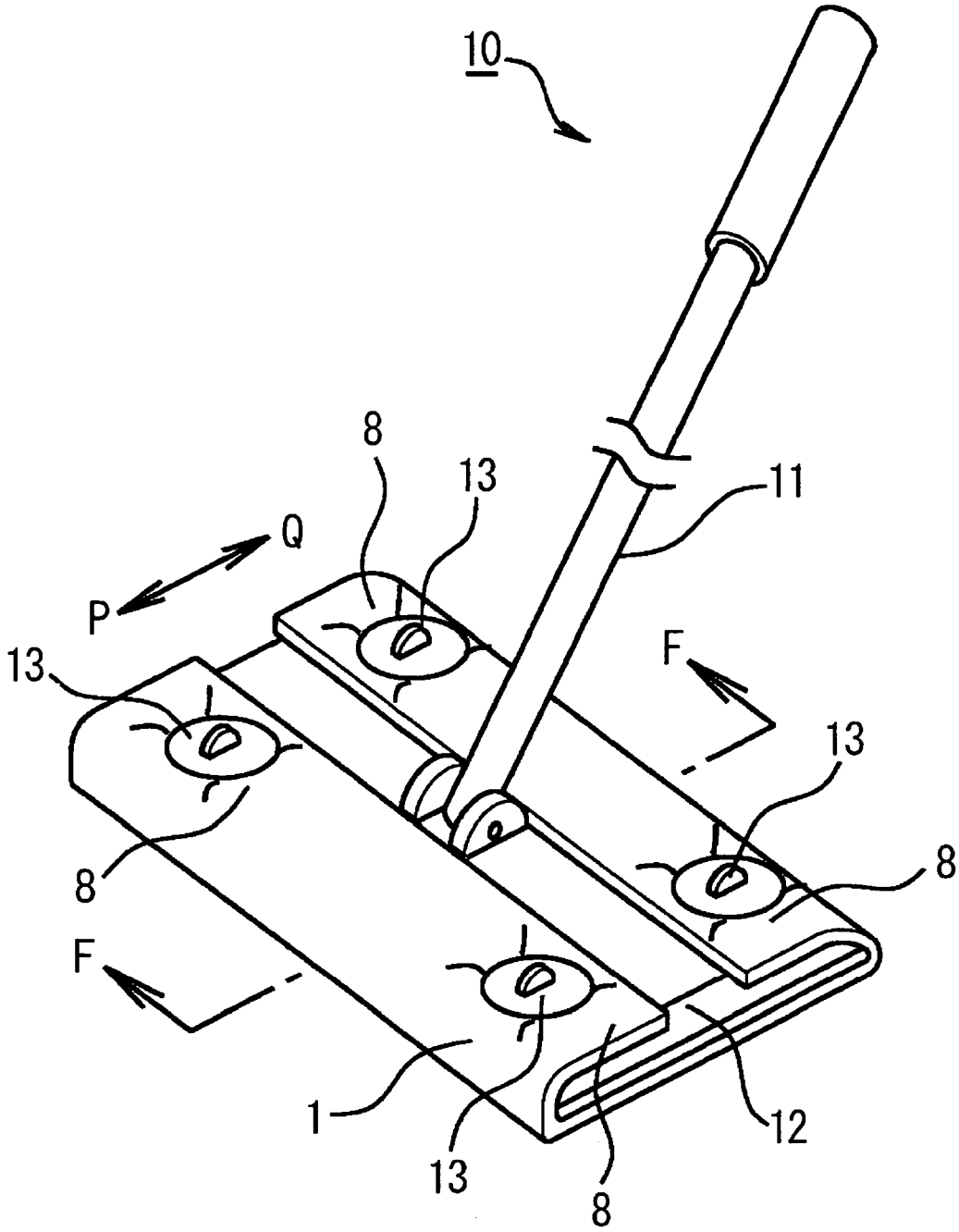

【FIG6】
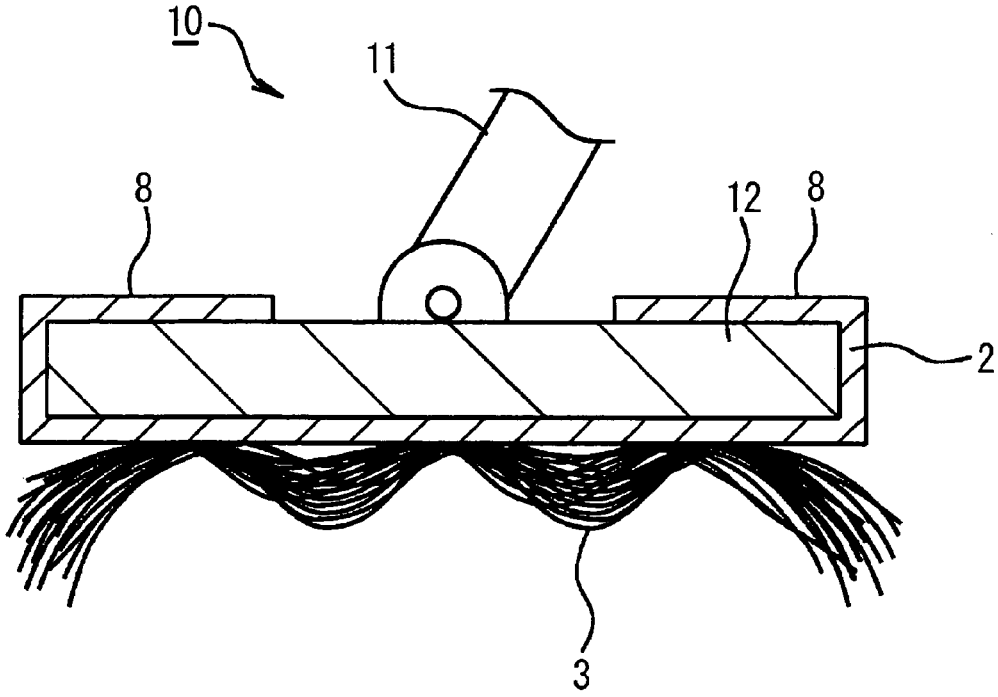
【FIG7】
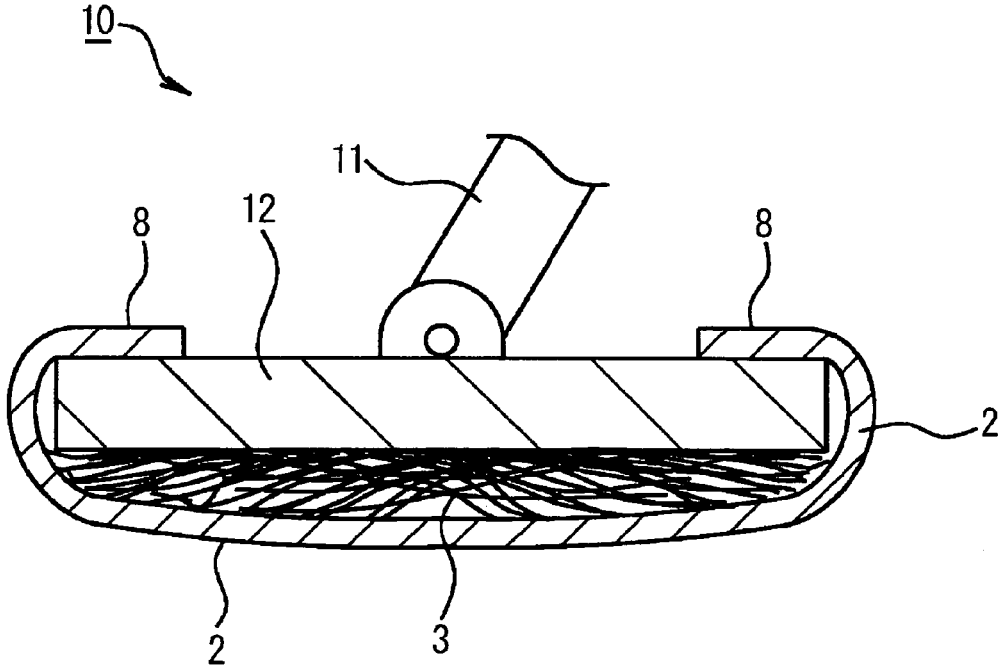

【FIG8】
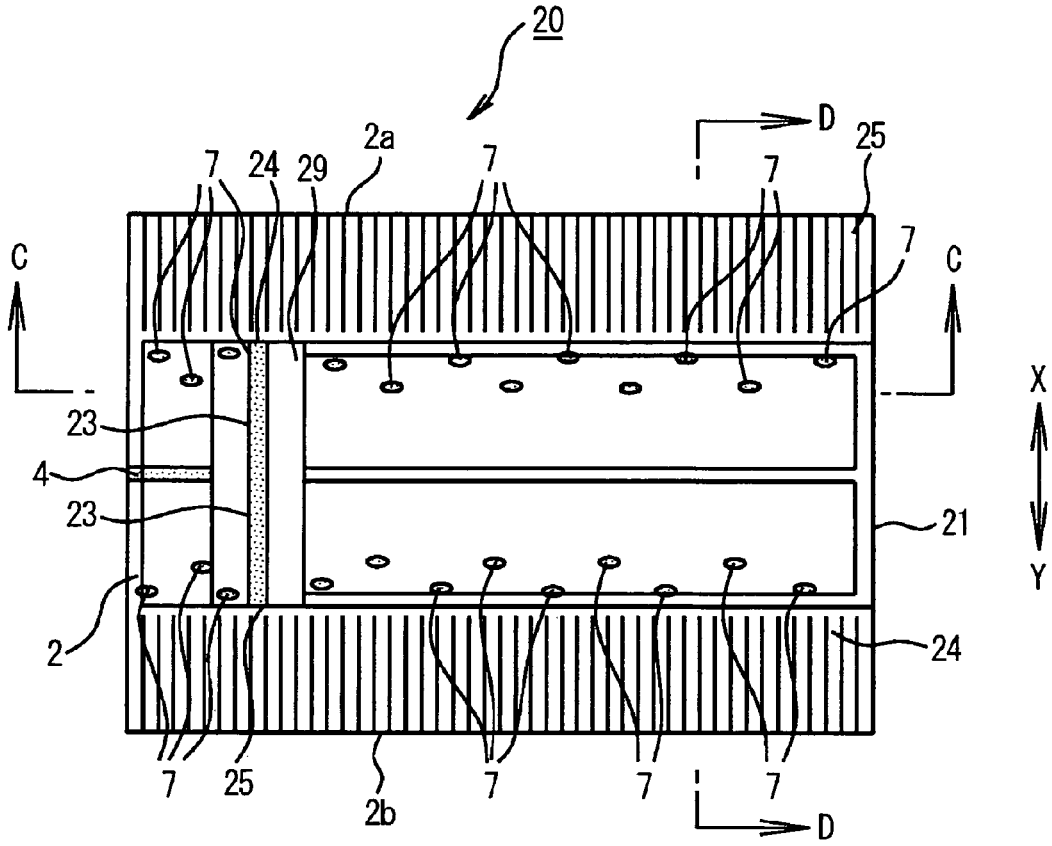
【FIG9】
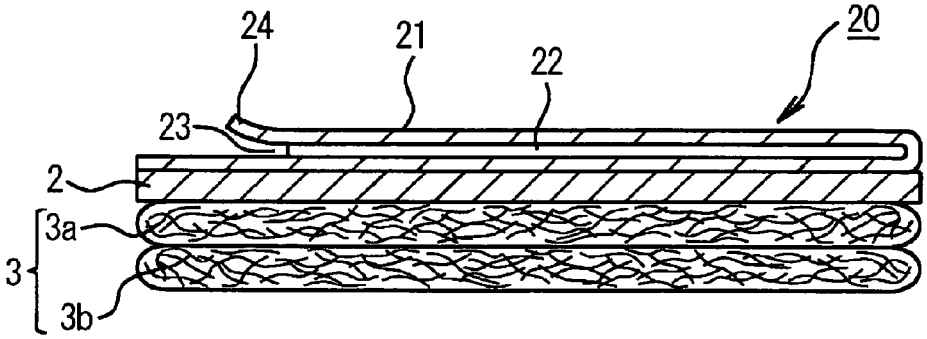

【FIG10】
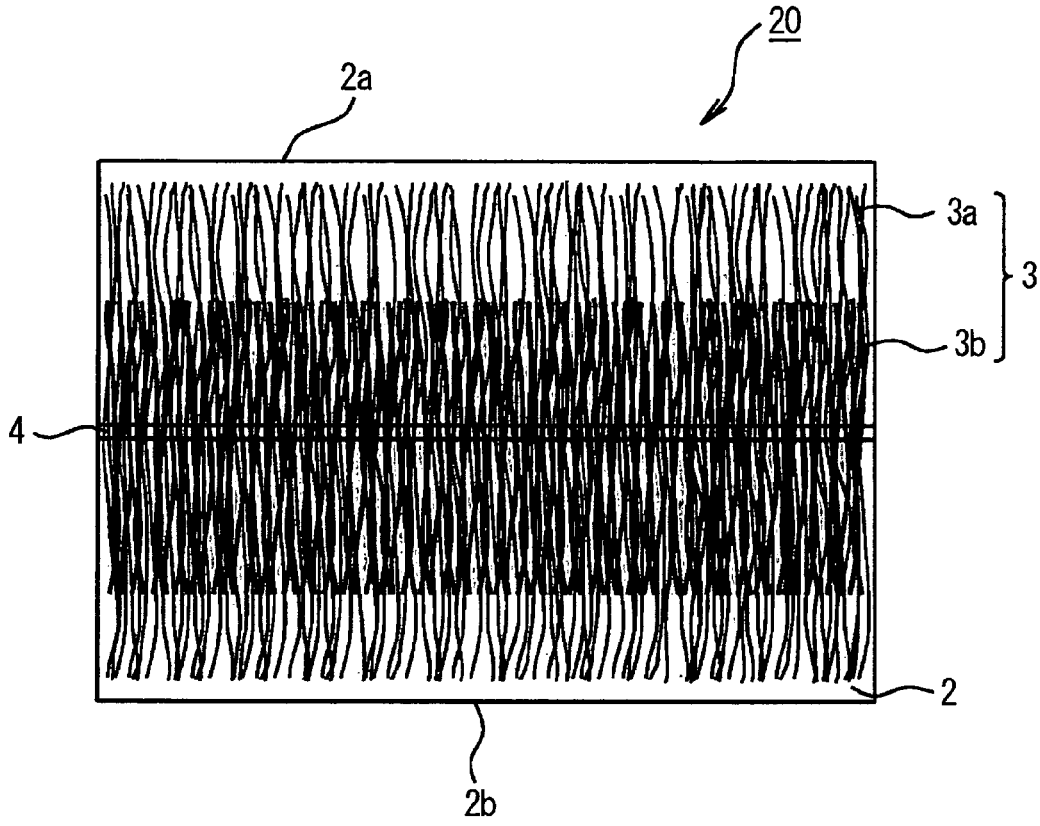
【FIG11】
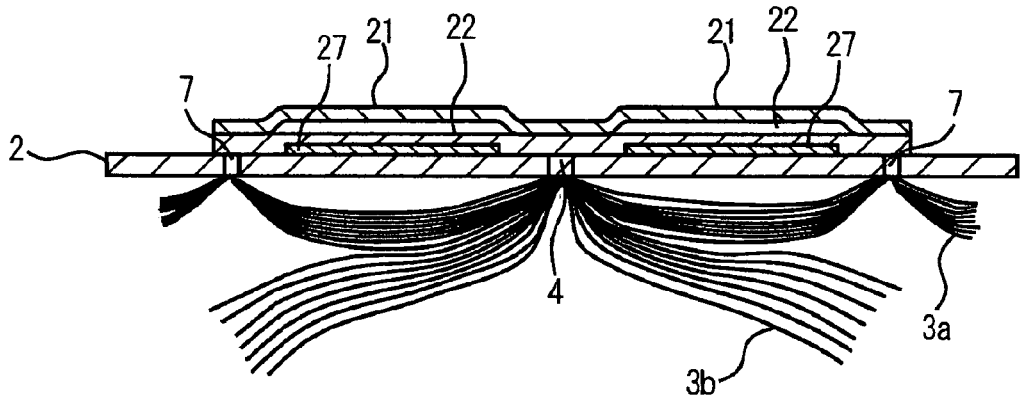

【FIG12】
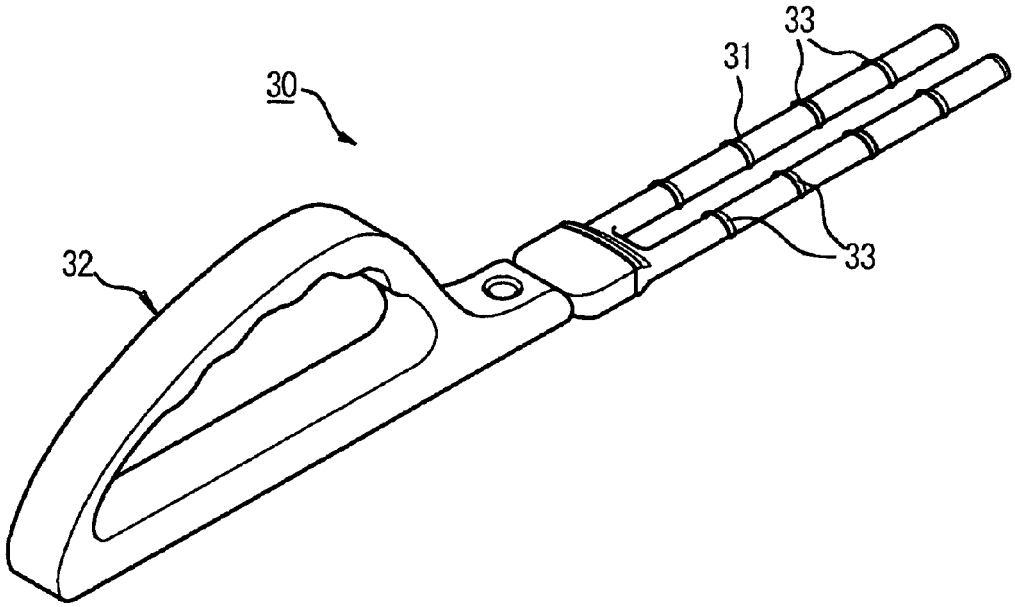
【FIG13】
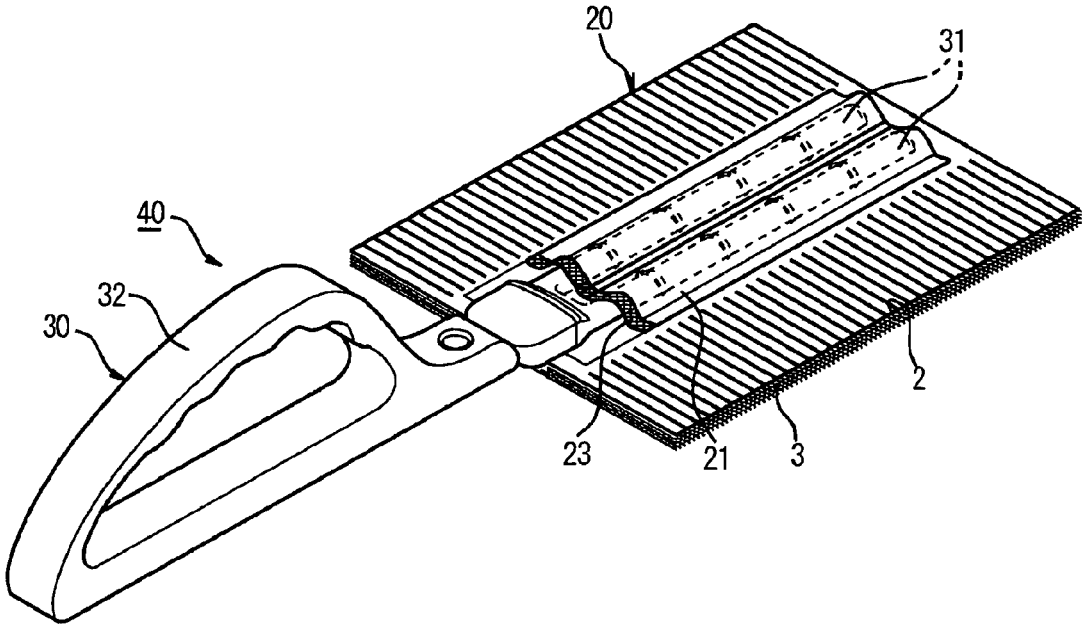

【FIG14】
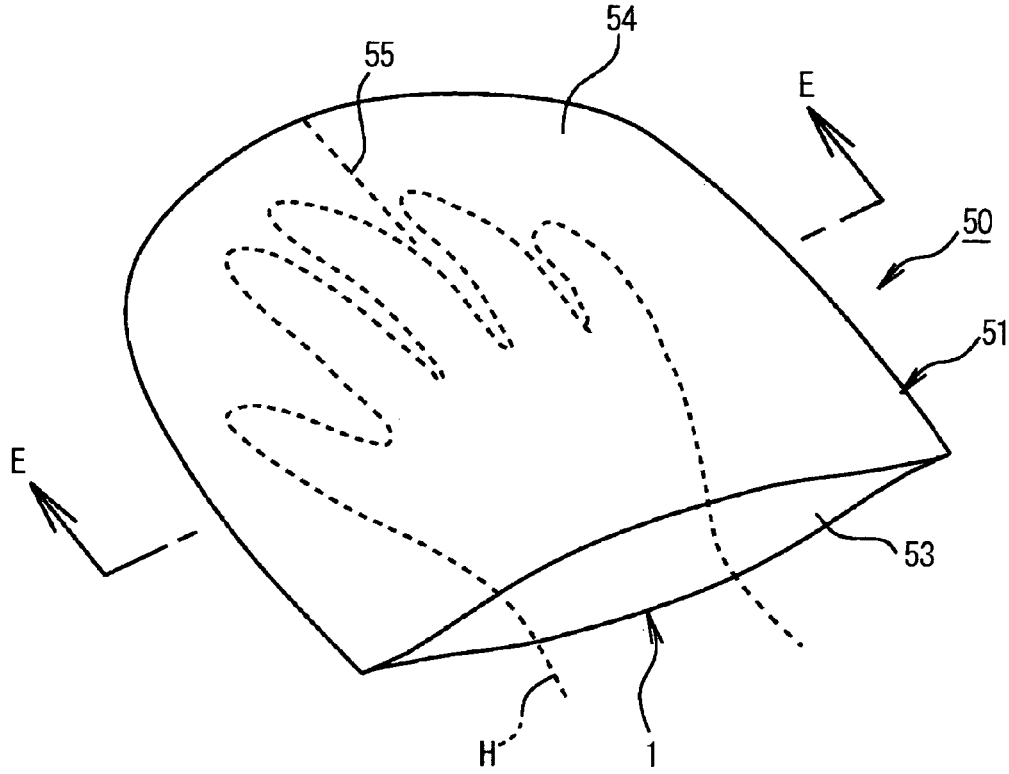
【FIG15】
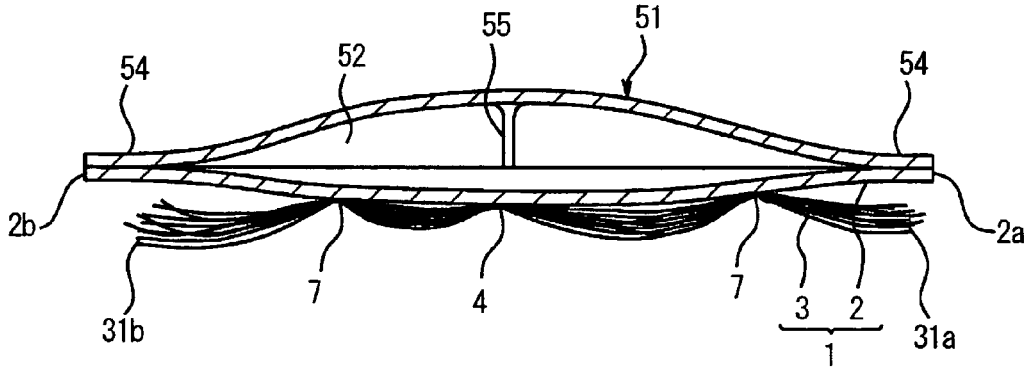

【FIG16】
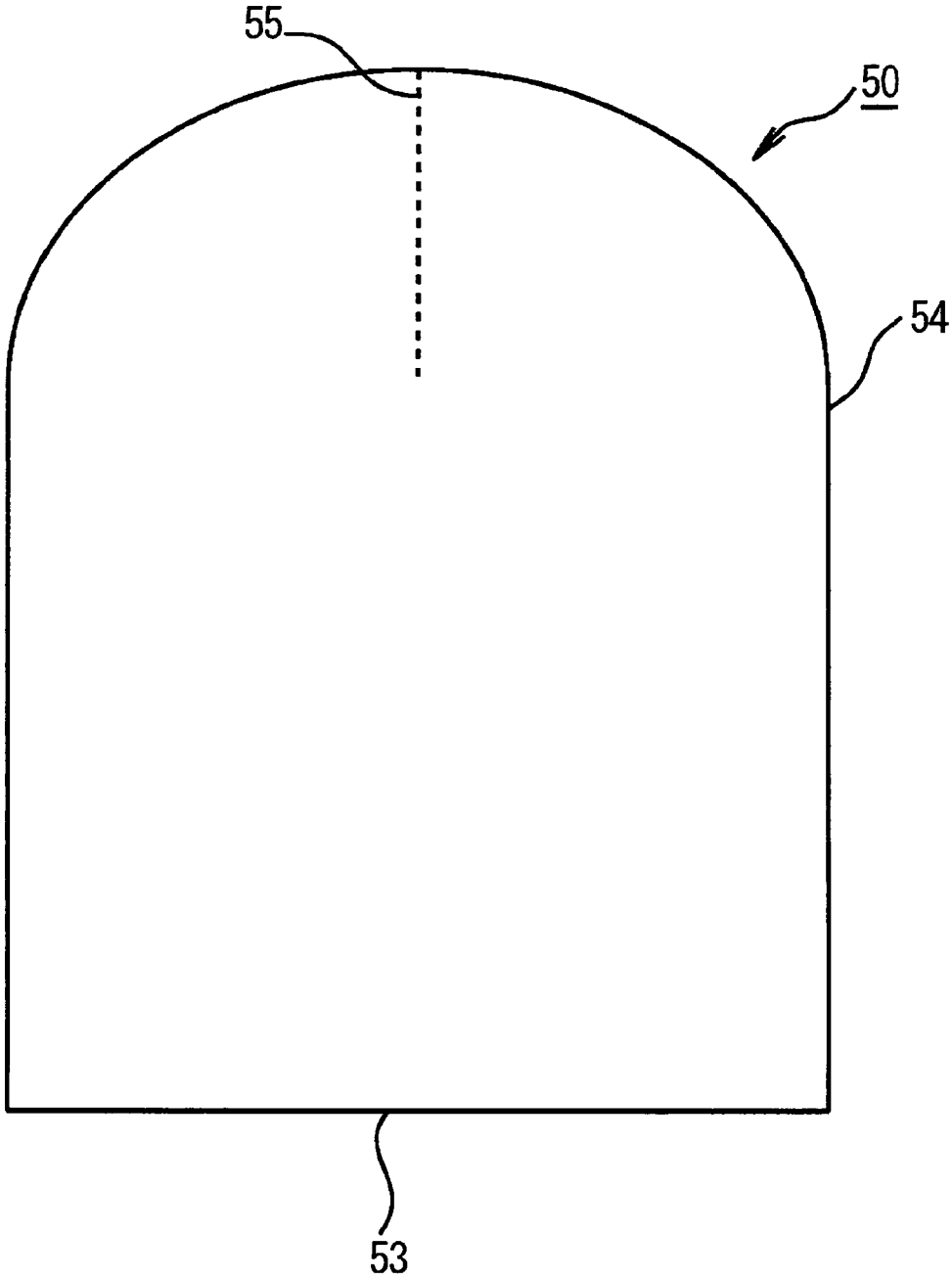

【FIG17】
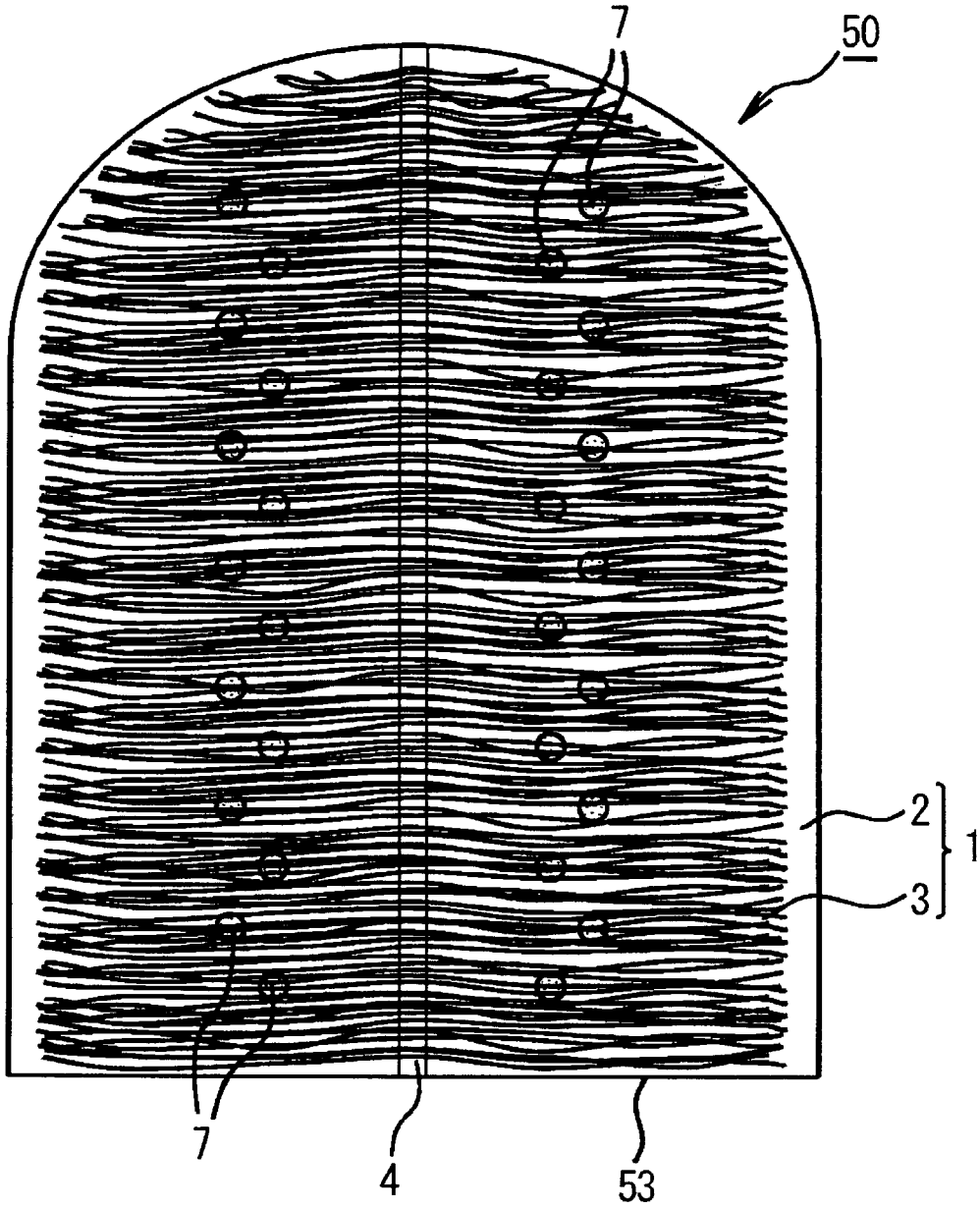

【FIG18】
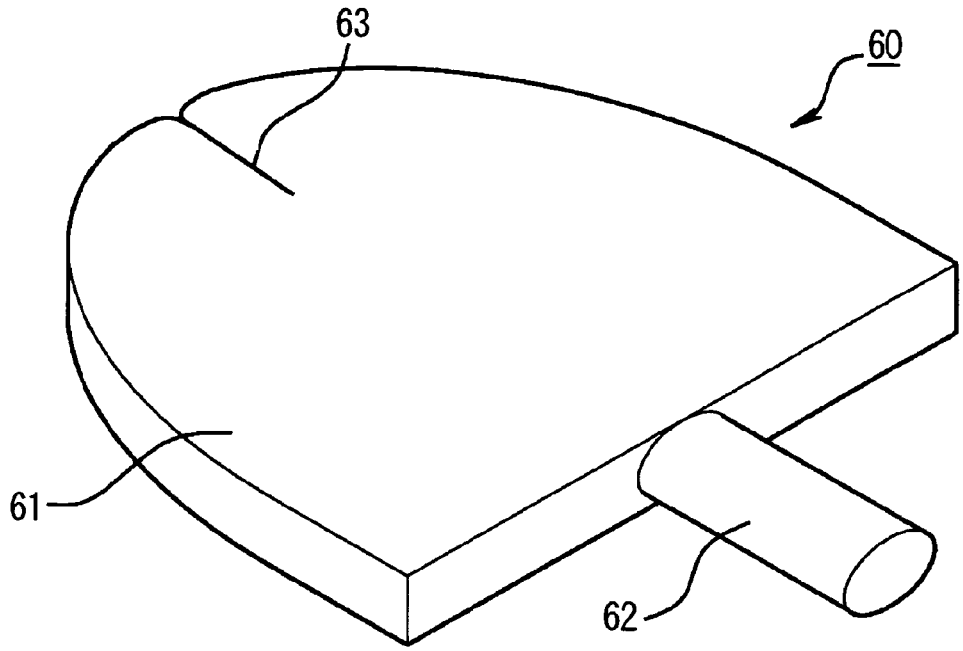
【FIG19】
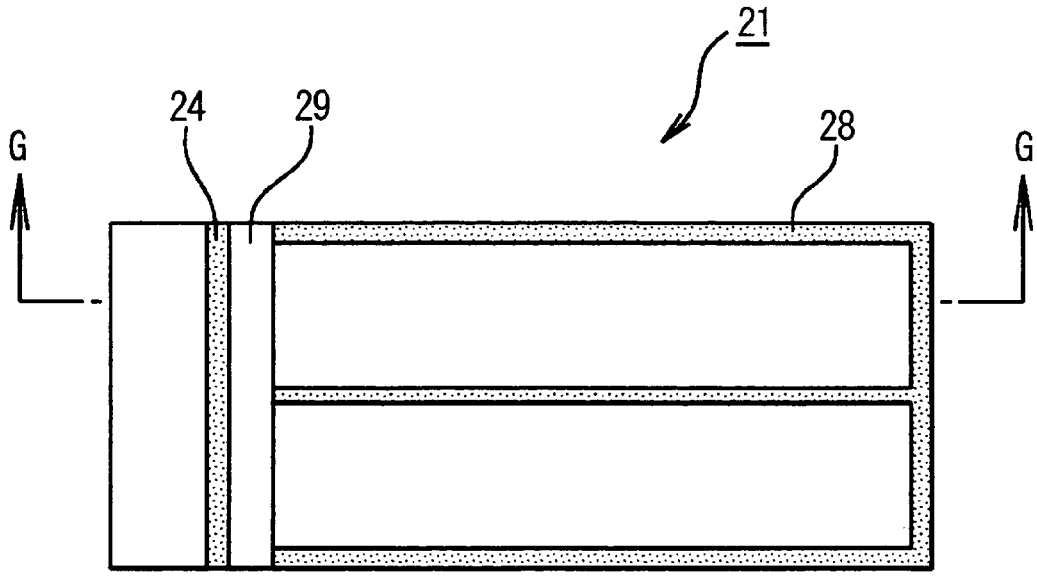

【FIG20】
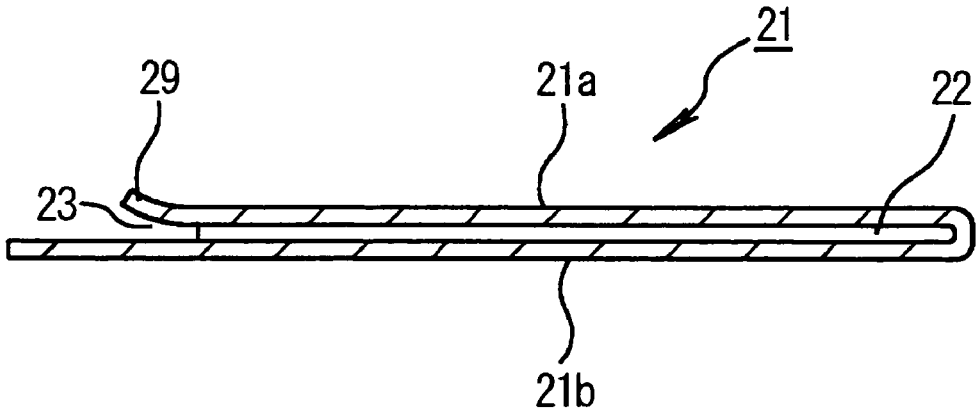

【FIG21】
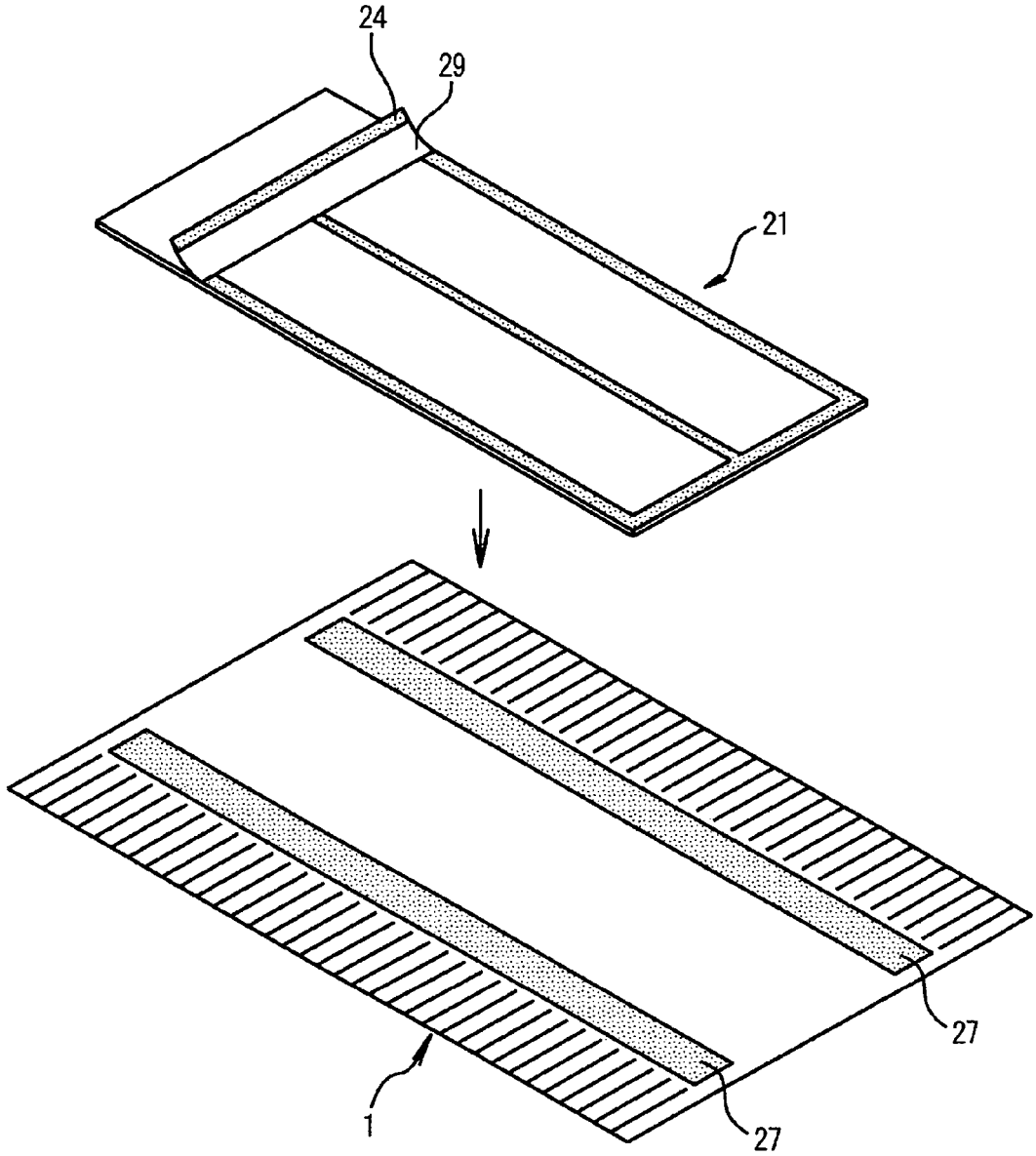

CLEANING TOOL SHEET AND CLEANING TOOL

The application is a divisional of U.S. patent application Ser. No. 10/577,992, filed Jun. 16, 2006, now U.S. Pat. No. 7,712,178.

TECHNICAL FIELD

The present invention relates to a cleaning tool sheet and a cleaning tool that are employed to wipe away dirt by contacting the surface of articles to be cleaned in various locations.

BACKGROUND ART

Sheets for cleaning tools employing nonwoven fabric are employed in cleaning tools used for cleaning by wiping away various types of dirt such as dirt or dust adhering to floors or walls, food scraps such as breadcrumbs, hair, thread dust or various other types of fine dirt. Sheets for cleaning tools are widely employed in the form of so-called throwaway or replaceable sheets which can be removed and replaced by a new sheet when they become contaminated to a certain degree. Known types of sheets for cleaning tools include (1) cleaning sheets having liquid paraffin or the like adhering to the surface of a nonwoven fabric sheet; and (2) sheets for cleaning tools (see Patent Reference 1) wherein joining threads are provided at fixed intervals intersecting with long fiber filaments in a fixed direction provided on a base sheet and constructed such that dust or debris is captured by nap raising at the surface by cutting some or all of the long fiber filaments between the joining threads.

However, the sheets for cleaning tools of (1) above could only capture fine particles of dirt adhering to the surface thereof and had a low ability to capture comparatively large particles of dirt. Also, the sheets for cleaning tools of (1) above had a low ability to hold the captured dust or debris. In contrast, the sheets for cleaning tools of (2) described above are capable of capturing dust by the long fiber portions that are formed on the surface thereof, thereby improving the capturing performance or holding performance in respect of dust or debris, but their ability to capture comparatively large particles of dirt is insufficient; better dirt capturing performance and holding ability are therefore sought.

Also, the aforementioned conventional cleaning tool sheet is employed (see Patent Reference 2) in a cleaning tool for wiping a floor surface by attaching to the undersurface of the pedestal of a holder constituted by joining a long handle to a flat-plate-form pedestal. To perform cleaning using this cleaning tool for wiping the floor surface, the cleaning tool is held by the handle and wiping is performed with the sheet for the cleaning tool attached to the pedestal pressed against the surface that is to be cleaned. The cleaning tool sheet that is attached to the pedestal is lacking in elasticity, since it is itself formed of thin nonwoven fabric or the like and so has scarcely any cushioning ability.

When a wiping task is performed using this cleaning tool for floor wiping, although the dirt can be comparatively efficiently captured at the periphery of the pedestal, since a large pressure is applied in this region, its ability to capture various types of dirt in the middle region of the pedestal is poor, since little pressure is applied in this region, compared with the peripheral region: there was therefore the problem that efficient use of the cleaning tool sheet as a whole could not be achieved.

Also, as a hand-held cleaning tool employed for removing dust or debris in rooms or vehicles, a "handy mop" (hand-held wiping cleaning tool) is known (see Patent Reference 3) that is used by inserting the attaching part of a grip that is constituted of a holding part and an attaching part having two flat parallel insertion plates in a gap for attaching a mop body having two parallel gaps for attaching (attachment gaps). The mop body that is employed in this hand-held wiping cleaning tool may be replaced by a new mop body when it becomes contaminated, so disposable type mop bodies are employed. For this mop body, a cleaning tool sheet is employed that is secured by thermal fusion on a line running transversely across the middle thereof and constituted by overlaying two or three sheets of nap-raised nonwoven fabric made of synthetic resin. On the upper surface of the mop body, there are formed two parallel attachment gaps between three thermal fusion lines; pieces of nonwoven fabric of short length are overlaid in the middle thereof on nonwoven fabric of the same size as the mop, being stuck in position on these three thermal fusion lines in the length direction.

However, since the cleaning tool sheet that is employed as a mop body of the aforesaid hand-held wiping cleaning tool is merely constituted by overlaying two or three sheets of nonwoven fabric made of nap-raised synthetic resin, its ability to capture comparatively large particles of dirt is insufficient, just as in the case of the cleaning tool sheet disclosed in Patent Reference 2; thus, further improvement in dirt capturing performance and holding ability are sought.

A cleaning tool that is formed in the form of a glove is also known (see Patent Reference 4). Specifically, this is of a construction adopting a design taking into account beforehand the desired borders where a wiping function is to be provided and engaging and overlaying two cut sheets, providing a hand insertion hole in which the fingers can be inserted and whose periphery is stitched or glued along the outline of the fingers; thus fine cleaning can be achieved by utilizing wiping sheet faces whereof the borders or the tip of the borders can abut and contact all the nooks and crannies of complex curved surfaces with a high degree of irregularity and enable transmission of a sensation of contact to the fingertips.

However, since the aforesaid conventional glove-form cleaning tool employed a wooly material or other wiping sheet or nonwoven fabric of excellent dirt capturing characteristics it was only able to capture fine particles of dirt adhering to its surface and its ability to capture comparatively large particles of dirt was low.

Also, with a conventional glove-form cleaning tool as described above, it was difficult to apply pressure at portions other than the fingertips so the ability to capture dirt was low. There was the problem of low efficiency, since capture of dirt could only be performed in an extremely restricted portion of the cleaning tool such as at the fingertips, portions other than these being substantially unused for capture of dirt.

Also, with a conventional glove-form cleaning tool as described above, the ability to hold captured dirt was restricted and the ability to capture comparatively large particles of dirt was insufficient; thus a cleaning tool of better capturing ability and holding ability for dirt was sought.

The present invention was made in order to solve the above problems, its object being to provide a cleaning tool sheet of excellent ability to capture and ability to hold various types of dirt such as dust or debris.

A further object, in a cleaning tool sheet employed in a cleaning tool for floor wiping, is to provide a cleaning tool sheet having a cushioning effect when attached to a pedestal for a cleaning tool so that pressure can be applied to the entirety from the peripheral portion to the central portion of the pedestal, and which thus exhibits the ability to capture various types of dust or debris over the entire surface to be cleaned and so is capable of efficiently utilizing this entire cleaning tool sheet.

Yet a further object is to provide a cleaning tool sheet having excellent dirt capturing ability and dirt holding ability in a cleaning tool sheet employed in a hand-held wiping cleaning tool.

Also a further object, in a glove-form cleaning tool, is to provide a cleaning tool of excellent ability to capture and ability to hold various types of dirt such as dust or debris that is easy to use and whereby the whole thereof can be efficiently utilized.

[Patent reference 1] Laid-open Japanese Patent Application No. 2000-245670

[Patent reference 2] Laid-open Japanese Patent Application No. 2000-296084

[Patent reference 3] Laid-open Japanese Patent Application No. 2003-265391

[Patent reference 4] Laid-open Japanese Patent Application No. 2003-510

DISCLOSURE OF THE INVENTION

The present invention consists in a cleaning tool sheet characterized in that fiber bundles are laminated on one side of a base sheet, the central parts in the direction of flow of the fibers constituting the fiber bundles are joined by a central joining part continuously formed in the central part of the base sheet and joined at a spot-form joining part formed intermittently on a parallel line between the central joining part and two end edges parallel therewith, but the two ends in the direction of flow of the fibers not being joined to the base sheet.

Although the cleaning tool sheet according to the present invention is formed with a spot-form joining part, it could be formed with a plurality of spot-form joining parts. Preferably the joining positions of the plurality of spot-form joining parts are formed such that they do not overlap in the direction of flow of the fiber bundles.

Preferably, in the cleaning tool sheet according to the present invention, although the fiber bundles are laminated on the base sheet, the base sheet and the fiber bundles have thermal fusibility.

While fiber bundles are employed in the cleaning tool sheet according to the present invention, preferably the thickness of the fibers constituting these fiber bundles is 1 to 18 denier.

In a cleaning tool sheet employed in a cleaning tool for floor wiping according to the present invention, fiber bundles are laminated on one side of a base sheet, the central parts in the direction of flow of the fibers constituting the fiber bundles are joined by a central joining part continuously formed in the central part of the base sheet and joined at a spot-form joining part formed intermittently on a parallel line between the central joining part and two end edges parallel therewith, but the two ends in the direction of flow of the fibers not being joined to the base sheet, and an attaching part for attaching to a holding member of the cleaning tool for floor wiping is provided at both end edges parallel with the central joining part of the base sheet.

In a cleaning tool sheet employed in a hand-held wiping cleaning tool according to the present invention, fiber bundles are laminated on one side of a base sheet, the central parts in the direction of flow of the fibers constituting the fiber bundles are joined by a central joining part continuously formed in the central part of the base sheet and joined at a spot-form joining part formed intermittently on a parallel line between the central joining part and two end edges parallel therewith, but the two ends in the direction of flow of the fibers not being joined to the base sheet, and a holding sheet formed with a holding part comprising a space for holding by insertion of a leg of a holding member of the hand-held wiping cleaning tool is joined on the side of the base sheet opposite to the face where the fiber bundles are laminated.

In a glove-form cleaning tool according to the present invention, a cleaning tool sheet is employed wherein fiber bundles are laminated on one side of a base sheet, the central parts in the direction of flow of the fibers constituting the fiber bundles are joined by a central joining part continuously formed in the central part of the base sheet and joined at a spot-form joining part formed intermittently on a parallel line between the central joining part and two end edges parallel therewith, but the two ends in the direction of flow of the fibers not being joined to the base sheet; and a glove-form external appearance is formed by laminating a second sheet on the base sheet side of the cleaning tool sheet and providing a holding part comprising a space for holding by insertion of a hand between the base sheet and the second sheet.

Since, with the cleaning tool sheet according to the present invention, the fiber bundles are joined in the central joining part and spot-form joining part and both ends in the direction of flow of the fibers are not joined to the base sheet, the fiber bundle region can be formed with high bulk with considerable nap raising of the fibers of the fiber bundles. Since the two ends in the direction of flow of the fiber bundles of the cleaning tool sheet hang downwards and the tip portions of the fibers at both ends of the fibers are liberated from the base sheet so that they are free to move, the ability to capture and ability to hold various types of dirt such as dust or debris is excellent in comparison with for example conventional sheets for cleaning tools whose surface nap is raised by cutting long fiber filaments.

Since the cleaning tool sheet according to the present invention is formed with a plurality of spot-form joining parts, in the fibers of the fiber bundles, the length from the central joining part to the spot-form joining part and the length from the spot-form joining part to the end are different; thus the fibers in the fiber bundles are formed with various different lengths, making it possible to prevent mutual entanglement of the fibers even more effectively. When a plurality of spot-form joining parts are formed, entanglement of the fibers can be reliably prevented, since the proportion of fibers of different lengths is increased by arranging that the spot-form joining parts do not overlap in the direction of flow of the fiber bundles.

If the base sheet and the fiber bundles of the cleaning tool sheet according to the present invention have thermal fusibility, these two can be joined and integrated by heating and applying pressure using a heating roll or the like, thereby making it possible to manufacture a cleaning tool sheet easily.

If the thickness of the fibers constituting the fiber bundles of the cleaning tool sheet according to the present invention is 1 to 18 denier, a reliable ability to capture and ability to hold a wide range of dirt from small dirt particles to large dirt particles are manifested.

Since, when attached to the pedestal of the cleaning tool, the ends of the fiber bundles hang downwards and are liberated from the base sheet so that they are free to move, in the cleaning tool sheet employed in a floor wiping cleaning tool according to the present invention, the fibers are unlikely to become entangled and excellent ability to capture and hold dust and debris or the like from the surface of the floor or the like to be cleaned is provided.

If a cleaning tool sheet employed in a floor wiping cleaning tool according to the present invention is attached such that the fiber bundles on the pedestal of the cleaning tool are on the inside while the base sheet is on the outside undersurface, the tips of the fiber bundles can move freely between the base sheet and the pedestal, so a bulky formation can be achieved providing an excellent cushioning effect. As a result, when wiping is performed using the base sheet surface, pressure is applied evenly over the entire surface from the peripheral part to the central part of the wiping portion, so there is excellent adherence between the wiping surface and the surface to be cleaned, making it possible to utilize the whole sheet effectively for cleaning.

Since, in a cleaning tool sheet employed in a hand-held wiping cleaning tool according to the present invention, fiber bundles are laminated on one side of a base sheet, the central parts in the direction of flow of the fibers constituting the fiber bundles are joined by a central joining part continuously formed in the central part of the base sheet and joined at a spot-form joining part formed intermittently on a parallel line between the central joining part and two end edges parallel therewith, but the two ends in the direction of flow of the fibers not being joined to the base sheet, and a holding part comprising a space for holding by insertion of a leg of a holding member of the hand-held wiping cleaning tool is formed on the side of the base sheet opposite to the face where the fiber bundles are laminated, the ends of the fiber bundles hang downwards and are liberated from the base sheet so that they are free to move, so the fibers are unlikely to become entangled and excellent ability to capture and hold dust and debris or the like from the surface to be cleaned is provided.

Since, in a glove-form cleaning tool according to the present invention, a cleaning tool sheet is employed wherein fiber bundles are laminated on one side of a base sheet, the central parts in the direction of flow of the fibers constituting the fiber bundles are joined by a central joining part continuously formed in the central part of the base sheet and joined at a spot-form joining part formed intermittently on a parallel line between the central joining part and two end edges parallel therewith, but the two ends in the direction of flow of the fibers not being joined to the base sheet and a glove-form external appearance is formed by laminating a second sheet on the base sheet side of the cleaning tool sheet and providing a holding part comprising a space for holding by insertion of a hand between the base sheet and the second sheet, in comparison with a conventional cleaning tool using nonwoven fabric or a wiping sheet, both ends of the fibers do not contact and are liberated from the base sheet, enabling free movement when performing cleaning, so the tool can enter the nooks and crannies of various types of surfaces to be cleaned having irregularities, such as the irregular keyboards of personal computers or ornamented furniture or domestic electrical products of a complex shape and has an excellent ability to wipe and capture dust or debris or the like and ability to hold such dirt.

Furthermore, since a glove-form cleaning tool according to the present invention is provided with a holding part for making it possible to hold the cleaning tool with a hand inserted, the fiber bundles are formed in a bulky manner when cleaning is performed with a hand inserted in the glove-form cleaning tool; this therefore provides excellent cushioning ability so that adherence to the surface to be cleaned is satisfactorily maintained over the entirety thereof, making it possible to utilize the entire sheet efficiently for cleaning.

BRIEF DESCRIPTION OF THE DRAWINGS

FIG. 1 is a plan view showing an example of a cleaning tool sheet according to the present invention;

FIG. 2 is a diagram showing a joining portion of a cleaning tool sheet according to FIG. 1;

FIG. 3 is an end face view showing a cross-section along the line A-A of FIG. 1;

FIG. 4 is an end face view showing a cross-section along the line B-B of FIG. 1;

FIG. 5 is a perspective view showing the external appearance of an example of a floor wiping cleaning tool employing a cleaning tool sheet according to the present invention;

FIG. 6 is a cross-sectional view along F-F showing the condition in which a cleaning tool sheet is attached such that the fiber bundle side is at the undersurface thereof in a floor wiping cleaning tool according to FIG. 5;

FIG. 7 is a cross-sectional view along F-F showing the condition in which a cleaning tool sheet is attached such that the base sheet side is at the undersurface thereof in a floor wiping cleaning tool according to FIG. 5;

FIG. 8 is a plan view showing an example of a cleaning tool sheet used in a hand-held wiping cleaning tool according to the present invention;

FIG. 9 is an end face view showing a cross-section along C-C of FIG. 8;

FIG. 10 is a bottom face view of a cleaning tool sheet according to FIG. 8;

FIG. 11 is an end face view showing a cross-section along D-D of FIG. 8;

FIG. 12 is a perspective view showing the external appearance of a holding member of a hand-held wiping cleaning tool;

FIG. 13 is a perspective view of the external appearance showing a hand-held wiping cleaning tool using a cleaning tool sheet according to FIG. 8;

FIG. 14 is a perspective view of the external appearance showing an example of a glove-form cleaning tool according to the present invention;

FIG. 15 is an end face view showing a cross-section along E-E of FIG. 14;

FIG. 16 is a view seen from the side of a second sheet of the glove-form cleaning tool of FIG. 14;

FIG. 17 is a view seen from the side of the sheet for the cleaning tool of the glove-form cleaning tool of FIG. 14;

FIG. 18 is a perspective view of the external appearance showing an example of a support member used in a glove-form cleaning tool according to FIG. 14;

FIG. 19 is a plan view showing a holding sheet used as a cleaning tool sheet according to FIG. 8;

FIG. 20 is an end face view showing a cross-section along the line G-G of FIG. 19;

FIG. 21 is a perspective view showing the step of laminating a holding sheet according to FIG. 19 onto a cleaning tool sheet.

DESCRIPTION OF THE PREFERRED EMBODIMENTS

As shown in FIG. 1 to FIG. 3, in a sheet 1 for a cleaning tool according to the present invention, fiber bundles 3 formed in sheet fashion by collecting a large number of fibers are laminated on one side face of a rectangular base sheet 2 made of nonwoven fabric or the like; in regard to the base sheet 2 and the fiber bundles 3, the central parts thereof in the direction of flow of the fibers constituting the fiber bundles 3 are joined with a central joining part 4 provided on a single continuous center line from one end edge 2*c* to the other end edge 2*d* of the rectangular shape in the central part of the rectangular base sheet 2.

Furthermore, as shown in FIG. 2, the fiber bundles 3 and base sheet 2 are joined at spot-form joining parts 7 formed in intermittent fashion on parallel lines 5*a*, 5*b*, 6*a*, 6*b* between the two end edges 2*a*, 2*b* parallel with the central joining part 4 of the base sheet 2. As shown in FIG. 2, the parallel lines 5*a*, 5*b*, 6*a*, 6*b* where the spot-form joining parts 7 are provided are formed between the central joining parts 4 and both end edges 2*a*, 2*b* of the base sheet 2.

As shown in FIG. 3, in the cleaning tool sheet according to FIG. 1, the centers of the fiber bundles 3 are joined with the central joining part 4 of the base sheet 2 and the fiber bundles 3 between this and one end edge 2*a* parallel with the central joining part 4 of the base sheet 2 are joined with the base sheet 2 by means of the spot-form joining parts 7. Also, the fiber bundles 3 between this and the other end edge 2*b* parallel with the central joining part 4 of the base sheet 2 are joined with the base sheet 2 by means of the spot-form joining parts 7. The ends 31*a*, 31*b* of the fiber bundles 3 in the direction of flow of the fibers are not joined with the base sheet 2 but are liberated therefrom.

Also, as shown in FIG. 4, the cross-section along B-B of FIG. 1 is a cross-section obtained by a parallel displacement of the cross-section along A-A but, between the one end edge 2*a* of the base sheet 2 and the central joining part 4, the fibers of the fiber bundles 3 are in a condition in which they are completely unjoined with the base sheet 2, since no spot-form joining parts 7 are present from the central joining part 4 up to the end 31*a* in the direction of flow of the fibers. Also, the fiber bundles 3 between the other end edge 2*b* of the base sheet 2 and the central joining part 4 of the fiber bundles 3 are joined by the spot-form joining parts 7. The ends 31*a*, 31*b* in the direction of flow of the fibers of the fiber bundles 3 are liberated without being joined with the base sheet 2. The fibers of the fiber bundles 4 are constituted so as to be able to move freely in a length from the central joining part 4 or spot-form joining part 7 up to the tips 31*a*, 31*b*.

In this way, in the sheet 1 for a cleaning tool, between the central joining part 4 and the ends 2*a*, 2*b*, the fiber bundles 3 are joined by means of the spot-form joining parts 7 constituting intermittent joining parts, so, when seen from the direction of flow of the central joining part 4, the length of free movement of the fibers from the end of the fiber bundle 3 up to the joining part is different in the portions where a joining part with the spot-form joining part 7 is provided and in the portions where such a joining part is absent; in this way, entanglement of the fibers of the fiber bundles 3 can be prevented.

As shown in FIG. 2, the spot-form joining parts 7 are provided directly above lines (parallel lines) 5*a*, 5*b*, 6*a*, 6*b* parallel with the central joining part 4 or in the vicinity of these lines. The spot-form joining parts 7 are lined up substantially linearly directly above the parallel lines 5*a*, 5*b*, 6*a*, 6*b* and are formed in non-continuous fashion intermittently in the linear direction of these parallel lines. The joining parts (spot-form parts) of the spot-form joining parts 7 formed intermittently on the parallel lines may be formed of circular shape, elliptical shape, oval shape or linear shape, for example; their shape may be formed of the same shape over the entire region of the spot-form joining parts or may be constituted by combining a plurality of the aforesaid shapes.

The widths of the spot-form parts constituting the spot-form joining parts 7 (in the direction of flow of the fibers) are preferably 0.5 to 5 mm and their lengths (in the longitudinal direction of the central joining part) are preferably 2 to 15 mm. Regarding the intervals of the joining parts of the spot-form joining parts 7 that are intermittently provided, the intervals with adjacent joining parts in the linear direction of the parallel lines are preferably formed such as to be 5 to 50 mm. The intervals of the spot-form joining parts may be constant over the entire region of the spot-form joining parts or may be different.

Also, the joining parts of the spot-form joining parts 7 may be formed so as to be positioned alternately on the left and right in the width direction centered on the parallel lines (direction of flow of the fiber) or so as to be positioned in zigzag fashion on the left and right, with the parallel lines as center lines. That is, the joining parts of the spot-form joining parts 7 need not necessarily be arranged in linear fashion on the line of the parallel lines.

Also, in the case of the sheet 1 for a cleaning tool according to the embodiment shown in FIG. 1, as shown in FIG. 2, the spot-form joining parts 7 may be provided on respectively two parallel lines (5*a*, 6*a* or 5*b*, 6*b*) between one end (2*a* or 2*b*) parallel with the central joining part 4 of the base sheet 2, so that, as a whole, the sheet 1 for the cleaning tool is provided on a total of four parallel lines on both sides of the central joining part 4.

In the sheet 1 for a cleaning tool according to the present invention, the spot-form joining parts 7 are not restricted to the above mode but could be embodied in other modes. For example, the spot-form joining parts 7 could be provided on a single parallel line between the central joining part 4 and the end edge 2*a* on one side and on a single parallel line between the central joining part 4 and the end edge 2*b* on the other side, so that, in terms of the entire sheet 1 for a cleaning tool, they are provided only on a total of two parallel lines (for example 5*a* and 5*b*) on both sides of the central joining part 4.

Also, although not specifically shown in the drawing, the spot-form joining parts 7 could be provided respectively on three parallel lines between the central joining part 4 and the one end edge 2*a* or the end edge 2*b*; thus in terms of the sheet 1 for a cleaning tool as a whole, they may be provided on a total of six parallel lines or may be provided on four or more parallel lines on one side.

Also, although not specifically shown in the drawing, the spot-form joining parts 7 may be provided on two parallel lines between the central joining part 4 and the one end edge 2*a* and three parallel lines may be provided between the central joining part 4 and the other end edge 2*b*, so that, in terms of the sheet 1 for a cleaning tool as a whole, they are provided on a total of five lines; being provided on parallel lines of different number on one side and the other side of the central joining part 7 of the sheet for the cleaning tool.

In the case of the sheet 1 for a cleaning tool of the mode shown in FIG. 1, as shown in FIG. 2, the positions of joining of adjacent joining parts in the spot-form joining parts 7 of the parallel lines 5*a* between the central joining part 4 and the one end 2*a* and the spot-form joining parts 7 of the parallel line 6*a* adjacent to this spot-form joining part may be formed so as not to overlap in the direction of flow of the fiber bundles 3. Likewise, the positions of joining of adjacent joining parts in the spot-form joining parts 7 of the parallel lines 5*b* between the central joining part 4 and the other end 2*b* and the spot-form joining parts 7 of the parallel line 6*b* adjacent to this spot-form joining part may be formed so as not to overlap in the direction of flow of the fiber bundles 3. Also, the direction of flow of the fibers of the fiber bundles 3 of the sheet 1 for a cleaning tool according to the mode shown in FIG. 1 may be arranged so as to be in a direction orthogonal to the central joining part 4.

If the joining parts of the spot-form joining parts 7 are formed in this way so as not to overlap in the direction of flow of the fibers of the fiber bundles 3, any possibility of a single fiber being joined at a plurality of locations in the direction of flow is eliminated, so the portions where the fibers can move freely are increased, preventing obstruction of movement of the fibers and so making it possible to satisfactorily prevent entanglement of the fibers of the fiber bundles 3; thus dirt capturing and holding ability can be maintained over a long period.

The length from the central joining part 4 of the fibers of the fiber bundles 3 to both ends in the direction flow of the fibers is preferably formed to be a length of 50 to 100% of the length from the central joining part 4 to the end edge (2*a* or 2*b*) of the base sheet 2. Specifically, if for example a sheet 1 for cleaning of transverse width 300 mm and a base sheet 2 of length 200 mm are employed, the length from the central joining part 4 to the end edge (2*a* or 2*b*) of the base sheet 2 is preferably 100 mm and the length of the fibers of the fiber bundles 3 is preferably formed to be 50 to 100 mm.

Also, as shown in FIG. 3 and FIG. 4, although the ends 31*a*, 31*b* in the direction of flow of the fibers of the fiber bundles 3 are not joined with the base sheet 2, the length of the portion of so-called free movement from the ends 31*a*, 31*b* up to the joining parts of the fibers of these fiber bundles 3 is preferably 10 to 40 mm. This can be achieved by forming spot-form joining parts 7 such that the parallel lines (for example 5*a*, 5*b*, 6*a*, 6*b*) where the spot-form joining parts 7 are provided are in the range of 10 to 40 mm from the end edges 2*a*, 2*b* of the base sheet 2.

As the material of the base sheet 2, apart from nonwoven fabric, for example paper or synthetic resin sheet may be employed. From the point of view of ability to capture various types of dirt, preferably the base sheet 2 is made of nonwoven fabric sheet. Preferably, if nonwoven fabric is employed for the base sheet 2, the quantity thereof is 10 to 200 g/m$^2$ and if synthetic resin sheet is employed the thickness thereof is preferably 0.01 to 0.1 mm.

If thermally fusible fibers are employed for the fiber bundles 3, from the point of view of ease of joining with these fiber bundles 3, preferably the base sheet 2 also has thermal fusibility. Also, although there is no particular restriction if nonwoven fabric sheet is employed, preferably the short fibers (fiber bodies) constituting the sheet are short fibers having thermal fusibility with the fiber bundles 3. Examples that may be given of such short fibers having thermal fusibility include fibers such as polypropylene, polyethylene or polyethylene terephthalate and composite fibers of these of the sheath/core type or side-by-side type.

Examples that may be given of the nonwoven fabric sheet employed as the base sheet 2 include spanless nonwoven fabric, span-bonded nonwoven fabric, thermally bonded nonwoven fabric, air-through bonded nonwoven fabrics, or point-bonded nonwoven fabrics and the like. Span-bonded nonwoven fabrics, thermally bonded nonwoven fabrics and the like are especially desirable in this case. The nonwoven fabric sheet that is used may be constructed from a single sheet, or may be constructed by laminating a plurality of sheets of the same or different types.

The fiber bundles 3 that are used in the sheet 1 for a cleaning tool are aggregates of fibers that are overlapped side by side so that numerous fibers are oriented in the same direction, with the respective fibers being wrapped to an extent that prevents the fibers from coming undone. The fiber bundles 3 are formed into sheets and are handled as sheet-form fiber bundles. Also, the fiber bundles 3 may be partially mutually coupled by thermal fusion or the like. The fiber bundles 3 may be constituted of fibers of the same type or may be constituted of fibers of a plurality of different types.

The fiber bundles 3 may be constituted solely of fibers of the same thickness or may be constituted of fibers of a plurality of thicknesses. Irrespective of whether the fiber bundles 3 are the same or different in respect of the types of constituent fibers and their thickness, they may be constituted of fibers of different colors.

For example, natural fibers such as cotton, wool or the like, synthetic fibers such as polyethylene, polypropylene, polyethylene terephthalate, nylon, polyacrylics or the like, composite fibers such as core-sheath type fibers, ocean-island type fibers, side-by-side type fibers or the like are used as the fiber bundles 3. Thermally fusible synthetic fibers or composite fibers are preferable, in particular core-sheath type composite fibers whose core is made of polypropylene and whose sheath is made of polyethylene are desirable since they combine the excellent thermal fusibility of the polyethylene constituting the sheath with the "body" of the polypropylene constituting the core.

Also, the fibers that are employed for the fiber bundles 3 may be crimped, being for example mechanically crimped or thermally crimped.

Furthermore, the fiber bundles 3 may also be long fiber bundles generally called "tow" that are manufactured from polyethylene, polypropylene, nylon, polyester, rayon or the like.

Preferably the thickness of the fibers constituting the fiber bundles 3 is 1 to 18 denier. Also, preferably the quantity of fiber bundles 3 is 5 to 30 g/m$^2$ if the thickness of the fibers is 2 denier.

For the fiber bundles 3, two or more fiber bundles in sheet form can be used in overlapping fashion. If fibers in sheet form are used in overlapping fashion, fiber bundles of different types of constituent fibers, thickness and fiber color may be combined at will. If fiber bundles of different colors are employed in overlapping fashion, aesthetic characteristics of the cleaning tool sheet can be improved.

Preferably, if a plurality of fiber bundles are employed in overlapping fashion, fiber bundles of slender fibers and fiber bundles of thick fibers may be superimposed alternately. As the aforementioned slender fibers, fibers of 0.01 to 0.05 mm are preferable. As the aforementioned thick fibers, which may be thicker than the slender fibers, fibers of thickness 0.06 mm to 0.3 mm are preferable. Also, for the thick fibers, preferably fibers such as polypropylene having "body" may be employed.

As the fiber bundles 3*b* consisting of thick fibers laminated onto the base sheet 2 of the sheet 1 for a cleaning tool shown in FIG. 8 to FIG. 11, fiber bundles are employed constructed from fibers that are formed by splitting a drawn polypropylene tape in the direction of drawing so that the fibers are made long and slender. Also, the fiber bundles 3*b* are laminated onto the fiber bundles 3*a* and joined by thermal fusion at the central joining part 4.

When fiber bundles of thick fibers and fiber bundles of slender fibers are used in this way in laminated fashion, preferably the thick fibers are laminated so as to be on the outside (i.e. on the side of the body to be cleaned). For example, when cleaning an object such as a computer keyboard, which has narrow crevices, the slender fibers do not easily enter the crevices owing to their lack of body. In contrast, the thick fibers have body and so easily enter the crevices, making it possible to scrape out dirt such as dust or debris. The slender fibers then function to take up the dirt that has been scraped out. The thick fibers also prevent mutual entanglement of the slender fibers.

A sheet 1 for a cleaning tool according to the present invention may be obtained by laminating fiber bundles 3 onto the surface of a base sheet 2 and joining with the central joining part 4 and spot-form joining parts using prescribed joining means in accordance with the material properties of the base sheet 2 and fiber bundles 3, using means such as thermal fusion, ultrasonic fusion, gluing, or sewing.

If for example the base sheet 2 and the fiber bundles 3 are of material that is capable of thermal fusion, they can easily be joined by applying heat and pressure to a laminated body consisting of the base sheet 2 and fiber bundles 3 using for example a heated roll.

Also, if the base sheet 2 and the fiber bundles 3 are of material that is not capable of thermal fusion, they may be laminated with thermally fusible material such as hot melt adhesive laminated between these or may be joined by for example applying adhesive thereto.

As shown in FIG. 2, in the sheet 1 for a cleaning tool, the vicinities of the four corners at the sides of the two ends 2*a*, 2*b* parallel with the central joining part 4 and closer to the central joining part 4 than the spot-form joining parts 7 may be formed as attaching parts 8, 8, 8, 8 constituted solely by the base sheet 2. These attaching parts 8 serve for attaching onto the holding member of the cleaning tool (see FIG. 5) when the sheet is employed as a cleaning tool sheet that is used for floor wiping.

The attaching parts 8 of the sheet 1 for a cleaning tool are not restricted to a mode constituted solely from the base sheet 2 as described above and could be formed embodied in various ways depending on for example the attaching means or the shape of the holding member, so longer as they make it possible to attach the cleaning tool for floor wiping to the holding member.

For example, the attaching parts 8 could be constituted by providing a tacky adhesive layer on the front surface and/or back surface of the base sheet 2, the outer surface of this tacky adhesive layer being covered with a peel-off sheet. If a sheet 1 for a cleaning tool is formed in this way, when attaching to the cleaning tool 10 for floor wiping, the tacky adhesive layer can be joined at the position of a stop 13 on the upper surface of the pedestal 12 after removing the peel-off sheet. It should be noted that, if a tacky adhesive layer is provided on the attaching parts 8 of the cleaning tool 1 for floor wiping, attaching could be effected onto the pedestal 12 of a cleaning tool 10 for floor wiping that is not provided with a fixed member such as the stop 13. Also, although not particularly shown in the drawing, it would be possible to provide slits in the sheet 1 for a cleaning tool for attaching onto for example the pedestal of the cleaning tool in the attaching parts 8, 8, 8, 8 in the vicinity of the two end edges 2*a*, 2*b* in the direction of flow of the fibers of the fiber bundles 3.

The base sheet 2 and/or fiber bundles 3 of the sheet 1 for a cleaning tool according to the present invention could be coated with an agent for enhancing the dirt capturing ability. Examples of such an agent that may be mentioned include an oiling agent or the like containing a mineral oil such as liquid paraffin or the like, a silicone oil or a nonionic surfactant.

FIG. 5 is a perspective view showing the external appearance of an example of a cleaning tool for floor wiping. A cleaning tool sheet employed in a floor wiping cleaning tool (floor cleaning tool sheet) according to the present invention is described below. As shown in FIG. 5, the floor wiping cleaning tool 10 comprises a pedestal 12 formed in the shape of a rectangular plate and constituting a holding member for the floor cleaning tool sheet 1, and an handle 11 that is attached to the upper surface of this pedestal 12. Cleaning of the floor is effected by attaching the floor cleaning tool sheet 1 to the pedestal 12 of the floor wiping cleaning tool 10, using the handle 11 to bring the undersurface of the pedestal 12 into contact with the floor and moving the handle 11 so that the pedestal 12 is moved chiefly in the direction of the arrow P-Q in the FIG.

A sheet 1 for a cleaning tool as shown in FIG. 1 to FIG. 4 may be employed for the floor cleaning tool sheet 1. In the floor cleaning tool sheet 1, attaching parts 8 at the sides of the two end edges 2*a*, 2*b* parallel with the central joining part 4 in the vicinity of the four corners of the base sheet 2 are provided for attaching thereof to the pedestal 12, which is the holding member of the floor wiping cleaning tool 10. The attaching parts 8 are portions constituted solely by the base sheet 2 in portions corresponding to the position of the stop 13 that is provided on the pedestal 12 as an attachment element, so only the base sheet 2 needs to be fixed by means of the stop 13 of the pedestal 12.

As shown in FIG. 6, when the floor cleaning tool sheet 1 is attached to the pedestal 12, it is employed by being fixed to the pedestal 12 such that the side of the fiber bundles 3 is on the outside of the undersurface of the pedestal 12. Attaching is effected on the pedestal 12 such that the direction of flow of the fibers of the fiber bundles 3 of the floor cleaning tool sheet 1 is in the same direction as the main direction of wiping by the floor wiping cleaning tool 10 (direction of the arrow P-Q). As shown in FIG. 6, when cleaning is effected by wiping the floor using the floor wiping cleaning tool 10, dirt is taken up, captured and held in the gaps between the fibers of the fiber bundles 3.

Also, as shown in FIG. 7, if, for the base sheet 2 of the floor cleaning tool sheet 1, a sheet is employed having dirt capturing ability, such as a nonwoven fabric sheet or the like, when this is attached to the pedestal 12 of the floor wiping cleaning tool 10, attaching can be effected such that the fiber bundles 3 are positioned between the undersurface of the pedestal 12 and the base sheet 2 by fixing to the pedestal 12 such that the side of the base sheet 2 is the outer undersurface of the pedestal 12. In this way, when the floor cleaning tool sheet 1 is attached, in the floor wiping cleaning tool 10, cushioning is provided by the fiber bundles 3 between the base sheet 2 and the pedestal 12, so extremely good adherence can be achieved with the surface to be cleaned such as the floor at the outside surface of the base sheet 2; thus it becomes possible to capture dirt using the entire undersurface of the base sheet 2, enabling cleaning to be performed in an efficient manner.

A method of use is thereby possible wherein for example as shown in FIG. 6, first of all comparatively large particles of dirt are picked up by wiping the floor with the floor wiping cleaning tool 10 attached with the fiber bundles 3 of the floor cleaning tool sheet 1 as the outside face and then, as shown in FIG. 7, the floor cleaning tool sheet 1 is turned over so that comparatively small particles of dirt can be captured by wiping the floor with the floor wiping cleaning tool 10 attached such that the base sheet 2 is on the outside face.

With this floor wiping cleaning tool 10, when the cleaning tool sheet 1 becomes contaminated, it may be removed from the pedestal 12 and replaced by another uncontaminated cleaning tool sheet 1.

As the cleaning tool sheet (hand-held cleaning tool sheet) 20 employed in the hand-held wiping cleaning tool according to the present invention, there may be employed a cleaning tool sheet 1 wherein, as shown in FIG. 8 to FIG. 11, fiber bundles 3 are laminated on one side face of the base sheet 2 and the central part in the direction of flow of the fibers constituting the fiber bundles 3 (i.e. the direction of the arrow X-Y in FIG. 8) is joined with the central joining part 4 formed continuously in the central part of the base sheet 2 and is joined at the spot-form joining parts 7 formed intermittently on parallel lines between the two end edges 2*a*, 2*b* parallel with the central joining part 4, but the two ends in the direction of flow of the fibers of the fiber bundles 3 are not joined with the base sheet 2.

The hand-held cleaning tool sheet 20 may be laminated and joined with a holding sheet 21 formed with a bag-shaped holding part 22 comprising a space for holding a leg of a holding member of the hand-held wiping cleaning tool by insertion therein, on the face of the base sheet 2 of the cleaning tool sheet 1, opposite to the face where the fiber bundles 3 are laminated.

Numerous cuts 25 which are formed in the. same direction as the direction of flow of the fibers of the fiber bundles 3 are formed from both end edges 2*a* and 2*b* parallel to the central joining part 4 of the base sheet 2 to the vicinity of the spot-form joining parts 7 in the hand-held cleaning tool sheet 20 shown in FIG. 8 to FIG. 11.

Also, the fiber bundles 3 of the hand-held cleaning tool sheet 20 shown in FIG. 8 to FIG. 11 comprise fiber bundles 3*a* made of slender fibers laminated on the side of the base sheet 2 and fiber bundles 3*b* made of thick fibers and laminated on the outside of these fiber bundles 3*a*. The fibers constituting the fiber bundles 3*b* consisting of thick fibers are constituted by gathering together fibers formed by splitting drawn polypropylene tape to produce fibers elongate in the direction of drawing. This confers the advantage that, in a condition in which joining is effected using solely the central joining parts 7 using these fibers having body, simply by holding the cleaning tool in the hand so that the fiber bundles 3*b* are directed downwardly, the thick fiber bundles 3*b* hang downwards, providing high bulk of the fiber bundles 3*b* so no special operation to achieve this is required.

Preferably the length of the fiber bundles 3*b* in the direction of flow of the fibers is formed such as to be somewhat shorter than that of the fiber bundles 3*a*; however, they could be of exactly the same length as the fiber bundles 3*a*.

In this way, by constituting the fiber bundles 3 of fiber bundles 3*a* and 3*b* of different thickness, as described in the description of the fiber bundles of the cleaning tool sheet shown in FIG. 1, an excellent wiping effect is obtained when cleaning portions such as narrow grooves.

The cleaning tool sheet 1 of the hand-held cleaning tool sheet 20 shown in FIG. 8 to FIG. 11 is obtained in the same way as in the sheet of FIG. 1 by first of all laminating fiber bundles 3*a* of slender fibers onto the base sheet 2 and joining by thermal fusion with the central joining part 4 and spot-form joining parts 7, then joining the fiber bundles 3*b* of thick fibers with the intermediate-layer joining part 4.

It should be noted that, in the cleaning sheet 1 of the hand-held cleaning tool sheet 20, the positions where the joining parts of the spot-form joining parts 7 that are intermittently formed on parallel lines between the two end edges 2*a*, 2*b* parallel with the central joining part 4 are provided is further inwards than the position where the cuts 25 are provided i.e. they are formed so as not to overlap the cuts 25.

In the cleaning tool sheet 1 of the hand-held cleaning tool sheet 20 shown in FIG. 8, in the same way as in the case of the sheet shown in FIG. 1, the spot-form joining parts 7 are formed using two parallel lines respectively provided as parallel lines between the two end edges 2*a*, 2*b* that are parallel with the central joining part 4. It would also be possible to form the spot-form joining parts 7 using four parallel lines respectively provided as parallel lines between the two end edges 2*a*, 2*b* that are parallel with the central joining part 4.

For the base sheet 2 and fiber bundles 3 (3*a*, 3*b*) of the hand-held cleaning tool sheet 20, the material indicated by the cleaning tool sheet 1 shown in FIG. 1 can be employed. Also, the construction of the central joining part 4 and spot-form joining parts 7 can be the same as the construction described with reference to the cleaning tool sheet 1 shown in FIG. 1.

Also, the hand-held cleaning tool sheet 20 shown in FIG. 8 to FIG. 11 may be constituted with the same type of color as that of the fiber bundles 3 and holding sheet 21.

As shown in FIG. 19 and FIG. 20, the holding sheet 21 is formed with a sealed part 28 constituted by laminating two sheets of nonwoven fabric 21*a*, 21*b* having thermal fusibility and joining three sides and the central part, excluding the insertion opening part 23, by heat sealing, and, between these two sheets of nonwoven fabric 21*a*, 21*b*, is formed with bag-form holding parts 22 comprising a space for holding by respectively inserting two legs 31 (see FIG. 12) of a holding member 30 of the hand-held wiping cleaning tool. The holding part 22 is formed in two bag-form configurations that are sealed on three sides (except for the opening parts) as respective holding parts in accordance with the size of the leg parts 2. Furthermore, in each holding part, at least the side surface sides may be sealed, and the tip end may be left in an open state without being sealed.

As is shown in FIG. 20, the portions of the insertion openings 23 of the holding sheet 21 are formed in an open state in which the two nonwoven fabric sheets 21*a* and 21*b* are not sealed to each other. The holding sheet 21 shown in FIG. 20 is formed by folding a single nonwoven fabric sheet in two, and heat-sealing at prescribed locations, lamination being effected with the upper portion of the nonwoven fabric at this insertion opening 23 being folded over so as to be longer than the lower portion of the nonwoven fabric. The nonwoven fabric sheet 21*a* on the upper side of the portion corresponding to the insertion openings 23 is formed as an ear part 29 that is not joined to the lower-side nonwoven fabric sheet 21*b*, being thus formed so that it can freely be bent over thereabove at the position of the end of the sealed part 28.

In addition, a colored part 24 which serves as a marker for each insertion part 23 is disposed on the end part of this ear part 29. Thus, the upper nonwoven fabric sheet 21*a* being longer than the lower nonwoven fabric sheet 21*b*, the passage of the leg parts 2 of the holding member can easily be accomplished if such an ear part 29 is provided.

Also, instead of providing a colored part 24 on the ear part 29 of the holding sheet 21, a pattern of surface irregularities could be provided by performing embossing processing. In this way, in a hand-held cleaning tool sheet 20, by providing a colored part 24 on the side of the insertion opening 23 of the holding sheet 21 or by providing a pattern of surface irregularities by embossing processing, when the legs 31 of the holding member 30 are inserted into the holding part 22, the inserted portion of the legs 31 can be easily ascertained visually, so the legs 31 of the holding member 30 can easily be inserted into the insertion opening 23 of the cleaning tool sheet 20 by a user.

Also, for the holding sheet 21, two nonwoven fabric sheets may be laminated and heat sealed, instead of folding over a single nonwoven fabric sheet and a construction may be adopted wherein the lengths of the upper nonwoven fabric sheet 21*a* and lower nonwoven fabric sheet 21*b* are the same.

As shown in FIG. 21, a hand-held cleaning tool sheet 20 may be obtained by applying hot melt adhesive 27 in the central part on the opposite side to the fiber bundles of the base sheet of the cleaning tool sheet 1, laminating the holding sheet 21 thereon and joining by using heating and pressurizing means, for example. It should be noted that the sticking on of the holding sheet 21 to the cleaning tool sheet 1 is not restricted to the use of hot melt adhesive and other types of adhesive or tacky adhesive or the like could be employed.

The hand-held cleaning tool sheet 20 may be employed as a hand-held wiping cleaning tool 40 as shown in FIG. 13 by attaching to the holding member 30 of the hand-held wiping cleaning tool shown in FIG. 12. The holding member 30 shown in FIG. 12 comprises legs 31 for holding a hand-held cleaning tool sheet 20 and a handle member 32 that is formed so as to be capable of being gripped by the hand. The legs 31 serve for attaching the hand-held cleaning tool sheet 20 and are formed as bifurcated branch members as shown in FIG. 12.

In order to attach the hand-held cleaning tool sheet 20 on the holding member 30, the legs 31 of the holding member 30 are inserted from the insertion opening 23 of the holding sheet 21 of the hand-held cleaning tool sheet 20 and held in the holding part 22. When the hand-held cleaning tool sheet 20 becomes contaminated, the legs 31 of the holding member 30 are extracted from the insertion opening 23 and replaced by another, uncontaminated hand-held cleaning tool sheet 20; in this way an excellent wiping effect is obtained.

The legs 31 for the holding member 30 of the hand-held wiping cleaning tool shown in FIG. 12 are formed in a shape obtained by cutting a cylinder in half. These legs 31 are provided with protrusions 33 that protrude outwards from their periphery at four locations having a prescribed interval in the length direction of the upper periphery of their respective branch members.

These protrusions 33 are formed as projections protruding such that the radius of the legs 31 becomes larger rearwardly than forwardly; thus they make it possible for the legs 31 to be inserted comparatively smoothly in the case of insertion from the tips of the legs 31 into the holding part 22 of the hand-held cleaning tool sheet 20 but can prevent the hand-held cleaning tool sheet 1 from escaping during performance of cleaning using the hand-held wiping cleaning tool 40; this is achieved by the protrusions 33 catching on the covering sheet 21 of the holding part if an attempt is made to extract the legs from the holding part 22 of the hand-held cleaning tool sheet 20.

FIG. 14 to FIG. 17 show an example of a glove-form cleaning tool according to the present invention. As shown in FIG. 14 to FIG. 17, the glove-form cleaning tool 50 according to the present invention employs a cleaning tool sheet 1 wherein fiber bundles 3 are laminated on one side face of the base sheet 2, the central part in the direction of flow of the fibers constituting the fiber bundles 3 is joined by the central joining part 4 formed continuously in the central part of the base sheet 2, and is joined at spot-form joining parts 7 formed intermittently on parallel lines between the two end edges parallel with the central joining part 4, but the two ends 31*a*, 31*b* in the direction of flow of the fibers are not joined to the base sheet 3.

In addition, in the glove-form cleaning tool 50, a second sheet 51 is laminated on the side of the base sheet 2 of the cleaning tool sheet 1 and the glove-form cleaning tool 50 is provided with a holding part 52 comprising a space for insertion and holding of a hand H between the base sheet 2 and a second sheet 51. Also its external appearance is formed in glove-form. The glove-form cleaning tool 50 is formed in glove-form with an insertion part 53 as an opening part, by the provision of a joining part 54 where joining is effected of the periphery of a laminated body constituted by laminating a cleaning tool sheet 1 and a second sheet 51, except for this insertion part 53 for insertion of a hand H. The joining of this peripheral joining part 54 can be effected by a method such as gluing using heat fusion, adhesive, or tacky adhesive or stitching and employing means such as hot melt severing of a laminated body, heating and/or pressurizing.

As shown in FIG. 16, at the tip of the glove-form cleaning tool 50 the peripheral joining part 54 is formed in a rounded shape around the shape of the hand except for the insertion part 53. By the "tip" of the glove-form cleaning tool 50 is meant the region of the fingertips when a hand is inserted i.e. the opposite side to the insertion part 53.

In addition, as shown in FIG. 14 to FIG. 16, in the holding part 52 in the interior of the glove-form cleaning tool 50, a partition 55 is provided that divides into two the tip region of the holding part 52 so that the glove-form cleaning tool 50 is formed in the shape of a mitten. As shown in FIG. 16, the partition 55 is provided linearly from the tip of the glove-form cleaning tool 50 towards the insertion part 53 and is formed of a length such that the end on the side of the insertion part of this partition 55 does not contact the root of the fingers when a hand H is inserted.

Although there is no particular restriction regarding the "glove-form" of the glove-form cleaning tool 50 so long as it is of a shape having a holding part 52 capable of performing holding by insertion of a hand H, preferably it is formed in mitten shape. It should be noted that, as shown in FIG. 14, "mitten shape" means a shape that is formed so as to make possible performance of holding by dividing the fingers into two spaces by dividing the holding part 52 into two by means of a single partition 55.

Also, the glove-form cleaning tool 50 according to the present invention could be constituted by providing two or more partitions 55 such that the holding part 52 is divided into three or more parts along the shape of the fingers. Also, a five-fingered glove shape can be formed by providing partitions 55 corresponding to the shape of the five fingers so that a holding part 52 is formed wherein each of the five fingers can separately enter the glove-form cleaning tool 50.

As shown in FIG. 15, a partition 55 may be formed so as to effect partitioning, by joining the cleaning tool sheet 1 and the second sheet 51. If the cleaning tool sheet 1 and the second sheet 51 have thermal fusibility, this joining may be effected by thermal fusion produced by heating and pressurizing. Also, if these two sheets do not have thermal fusibility, the joining may be effected by joining using adhesive or using stitching or the like.

FIG. 17 is a view of the glove-form cleaning tool 50 of FIG. 14 seen from the side of the cleaning tool sheet 1. As shown in FIG. 17, in the cleaning tool sheet 1, fiber bundles 3 are laminated onto the base sheet 1 and lamination is effected onto a second sheet 51 such that these fiber bundles 3 are on the outside (see FIG. 16).

Also, regarding the arrangement of the cleaning tool sheet 14 in the glove-form cleaning tool 50 shown in FIG. 17, the arrangement is such that the central joining part 4 is in the direction of insertion of hand and is in the center in the width direction of the hand. That is, the cleaning tool sheet 1 is attached such that its direction is the direction of the tip (vertical direction in FIG. 17) from the insertion part 53 of the cleaning tool 1, the central joining part 4 thereof being positioned in substantially the center in the width direction (left/right direction in FIG. 17) of the glove-form cleaning tool 50.

The direction of attaching of the cleaning tool sheet 1 of the glove-form cleaning tool 50 according to the present invention is not restricted to the embodiment described and it could be attached for example such that the longitudinal direction of the central joining part 4 is in a direction orthogonal to or intersecting with the direction of insertion of the hand H.

As shown in FIG. 17, preferably the glove-form cleaning tool 50 is constituted with the longitudinal direction of the central joining part 4 of the cleaning tool sheet 1 arranged so as to be in the same direction as the direction of insertion of the hand. Typically when performing wiping cleaning using the glove-form cleaning tool, wiping is normally performed by moving the hand to the left and right. This wiping direction is the same direction as the direction of flow of the fibers of the fiber bundles 3 of the cleaning tool sheet 1 of the glove-form cleaning tool 50. As a result, the fiber bundles 3 of the glove-form cleaning tool 50 can be efficiently utilized and satisfactory capture and holding of the dirt can be performed.

For the cleaning tool sheet 1, the cleaning tool sheet 1 shown in FIG. 1 may be employed. However, as shown in FIG. 17, the point of difference of the cleaning tool sheet employed in the glove-form cleaning tool from the cleaning tool sheet shown in FIG. 1 is that the shapes of the base sheet 2 and the fiber bundles 3 are formed corresponding to the glove shape of the glove-form cleaning tool 50. The cleaning tool sheet used in the glove-form cleaning tool 50 may be formed beforehand in a shape corresponding to the glove shape, but it is also possible to use a rectangular cleaning tool sheet 1 as shown in FIG. 1 by cutting it to the prescribed shape in accordance with the external shape of the glove-form cleaning tool.

Also in the glove-form cleaning tool 50, the second sheet 51 may be a sheet of any kind but it is preferable to employ a nonwoven fabric sheet having cleaning ability. For the nonwoven fabric sheet, the sheet indicated in the description of the nonwoven fabric sheet employed as the base sheet 2 of the cleaning tool sheet 1 may be employed. If wiping cleaning is performed using the glove-form cleaning tool 50 using a nonwoven fabric sheet for the second sheet 51, dirt such as dust or debris and hair in areas to be wiped on the side of the fiber bundles 3 of the cleaning tool sheet 1 that are of irregular surface shape is held by the fiber bundles 3 and may then be wiped away using the nonwoven fabric sheet on the side of the second sheet 51. Since the nonwoven fabric sheet is formed smoothly but with minute gaps, it captures fine dirt and can be used to polish smooth areas such as mirrors or glass or painted surfaces.

Apart from being used by insertion of a hand H into the holding part 52, the glove-form cleaning tool 50 according to the present invention may be used by inserting a separate holding member into the holding part 52. As shown in FIG. 18, for example a support member 60 may comprise a cleaning tool support part 61 that is formed in a shape corresponding to the shape of the holding part 52 of the glove-form cleaning tool 50 and a grip 62 constituting a handle for gripping by the hand.

The grip 62 is provided on the side of the insertion part 53 of the glove-form cleaning tool 50 of the support part 61. Also, in the support part 61, there is provided a slit 63 at a position corresponding to the partition 55 of the glove-form cleaning tool 50. As shown FIG. 18, a cleaning tool support part 61 of the support member 60 is formed in a flat-plate-form corresponding to the glove shape and a grip 62 of the support member 60 is formed in cylindrical shape.

When the support member 60 is employed in a glove-form cleaning tool 50, the support part 61 of the support member 60 is inserted into the holding part 52 from the insertion part 53 of the glove-form cleaning tool 50 and is attached such that the partition 55 enters the slit 63. By employing the glove-form cleaning tool 50 for cleaning with the grip 62 of the support member 60 held in the hand, the glove-form cleaning tool 50 can easily be employed for cleaning for example narrow gaps when the hand cannot directly enter.

INDUSTRIAL APPLICABILITY

The cleaning tool sheet, the floor wiping cleaning tool sheet, the hand-held wiping cleaning tool sheet and glove-form cleaning tool of the present invention can be utilized in wiping cleaning by being caused to contact the surfaces of objects of cleaning such as floors, walls, windows, furniture, household products, personal computers, illuminating devices, bookshelves, various types of metal products and the like in various locations such as ordinary households, factories, hospitals, shops, vehicle interiors and the like, and make it possible to wipe away and capture dirt such as dust, debris and the like in an efficient manner by means of a simple structure; furthermore, these cleaning tools are extremely effective in terms of being able to hold the captured dirt.

The invention claimed is:

1. A cleaning sheet for a hand-held cleaning tool comprising:

first and second nonwoven sheets bonded together to provide a holding part; and a fiber bundle that is bonded to the first nonwoven sheet, the fiber bundle comprising:

a first set of fibers that is bonded to the first nonwoven sheet at more than one location along respective lengths of the fibers in the first set, and a second set of fibers that is bonded to the first nonwoven sheet at a single location along respective lengths of the fibers in the second set, wherein a grouping of fibers in the first set is adjacent to a grouping of fibers in the second set along the length of the first nonwoven sheet; and wherein the fibers in the first set are substantially the same length as the fibers in the second set.

2. The cleaning sheet of claim 1, wherein the two nonwoven sheets are bonded at lateral edges to define a bag form holding part for receiving a holding member of a cleaning tool.

3. The cleaning sheet of claim 1, further comprising a central bonding line bonding the first and second nonwoven sheets together and dividing the holding part into two parts, and wherein the central bonding line bonds the first and second sets of fibers to the first nonwoven sheet.

4. The cleaning sheet of claim 3, further comprising a bonding line extending perpendicular to the central bonding line to close one end of the holding part.

5. The cleaning sheet of claim 3, further comprising a plurality of spot bonds that bond the first set of fibers to the first nonwoven sheet.

6. The cleaning sheet of claim 1, wherein the grouping of fibers in the first set of fibers and the grouping of fibers in the second set of fibers are in the same plane.

7. The cleaning sheet of claim 1, wherein bonds that bond the fiber bundle to the first nonwoven sheet are in the same plane.

8. The cleaning sheet of claim 1, wherein the first nonwoven sheet includes strips, and wherein bonds that bond the fiber bundle to the first nonwoven sheet are not located on the strips.

9. A cleaning sheet for a hand-held cleaning tool comprising:

a first nonwoven sheet; and a second nonwoven sheet attached to the first nonwoven sheet to provide a holding part, the holding part configured to receive a cleaning tool;

a first fiber bundle comprising:

a first set of fibers attached to the first nonwoven sheet at more than one location along respective lengths of the fibers in the first set; and a second set of fibers bonded to the first nonwoven sheet at a single location along respective lengths of the fibers in the second set, wherein groupings of fibers in the first set alternate with groupings of fibers in the second set along the length of the cleaning sheet;

wherein the respective lengths of the fibers in the first and second sets are between 50% and 100% of the length of the first nonwoven sheet in the direction of the flow of the fibers: and a second fiber bundle attached to the first nonwoven sheet.

10. The cleaning sheet of claim 9, further comprising a dividing means within the holding part, that divides the holding part into two parts.

11. The cleaning sheet of claim 10, wherein the dividing means is a bonding line that bonds the first nonwoven sheet, the second nonwoven sheet, the first fiber bundle and the second fiber bundle together.

12. The cleaning sheet of claim 11, further comprising a plurality of spot bonds that bond the first set of fibers in the first fiber bundle to the first nonwoven sheet.

13. The cleaning sheet of claim 12, wherein the spot bonds are arranged into lines positioned on opposite sides of the bonding line.

14. The cleaning sheet of claim 9, wherein the first nonwoven sheet is longer than the second nonwoven sheet.

15. The cleaning sheet of claim 14, wherein the cleaning sheet includes a marker for indicating the position for insertion of the cleaning tool.

16. The cleaning sheet of claim 14, wherein the marker is a colored part.

17. The cleaning sheet of claim 14, wherein the marker is a pattern of surface irregularities.

18. A method of forming a cleaning sheet for a hand-held cleaning tool comprising:

attaching a first sheet to a second sheet to provide a holding part, the holding part configured to receive a cleaning tool; and attaching a fiber bundle to the first sheet by:

attaching a first set of fibers in the fiber bundle to the first sheet by more than one bond along the lengths of the fibers in the first set, and attaching a second set of fibers in the fiber bundle to the first sheet by only one bond along the lengths of the fibers in the second set so that a grouping of fibers in the first set is adjacent to a grouping of fibers in the second set along the length of the first sheet;

wherein the fibers in the first set are substantially the same length as the fibers in the second set.

19. The method of claim 18, further comprising dividing the holding part into two discrete holding parts.

20. The method of claim 19, further comprising closing one end of the two holding parts.

21. A cleaning sheet comprising:

a nonwoven sheet bonded to a base sheet; and a fiber bundle bonded to the base sheet by a bonding line, the fiber bundle comprising:

a first set of fibers comprising fibers that are bonded to the base sheet by the bonding line and by an additional bond along respective lengths of the fibers, and a second set of fibers comprising fibers that are bonded to the base sheet only by the bonding line, wherein a grouping of fibers in the first set of fibers is adjacent to a grouping of fibers in the second set of fibers along the length of the cleaning sheet;

wherein the respective lengths of the fibers in the first and second sets are between 50% and 100% of the length of the base sheet in the direction of the flow of the fibers.

22. The cleaning sheet of claim 21, wherein the bonding line bonds the nonwoven sheet and the base sheet together to form two holding parts.

23. The cleaning sheet of claim 21, wherein the nonwoven sheet is shorter than the base sheet.

24. The cleaning sheet of claim 21, wherein for respective fibers in the first set of fibers, the additional bond is one of a plurality of spot bonds.

25. The cleaning sheet of claim 21, wherein the plurality of spot bonds is arranged in lines positioned on opposite sides of the bonding line.

26. The cleaning sheet of claim 21, wherein the grouping of fibers in the first set of fibers is one of a plurality of groupings, wherein the grouping of fibers in the second set of fibers is one of a plurality of groupings, and wherein respective groupings of fibers in the first set of fibers alternates with respective groupings of fibers in the second set of fibers along the length of the cleaning sheet.

27. The cleaning sheet of claim 26, wherein the groupings of fibers in the first set of fibers are defined by a plurality of spot bonds.

* * * * *